US007217877B2

(12) United States Patent
Funaki

(10) Patent No.: US 7,217,877 B2
(45) Date of Patent: May 15, 2007

(54) KEYBOARD APPARATUS

(75) Inventor: Tomoyuki Funaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 118 days.

(21) Appl. No.: 11/198,438

(22) Filed: Aug. 5, 2005

(65) Prior Publication Data

US 2006/0060057 A1 Mar. 23, 2006

(30) Foreign Application Priority Data

Aug. 5, 2004 (JP) ..... 2004-229422
Aug. 5, 2004 (JP) ..... 2004-229423

(51) Int. Cl.
*G10C 3/12* (2006.01)

(52) U.S. Cl. ..... 84/433

(58) Field of Classification Search ..... 439/136, 439/521, 147, 142, 144; 220/242; 174/67; 84/216, 433–436, 718–720, 743–745
See application file for complete search history.

(56) References Cited

U.S. PATENT DOCUMENTS 5,922,983 A * 7/1999 Muramatsu ..... 84/626
5,932,825 A 8/1999 Kumano
6,232,537 B1 * 5/2001 Kimble ..... 84/216
6,509,517 B1 * 1/2003 Wroblewski ..... 84/216
6,740,801 B2 * 5/2004 Yoshisue et al. ..... 84/452 P
6,930,234 B2 * 8/2005 Davis ..... 84/423 R
6,972,359 B2 * 12/2005 Overs ..... 84/216
2004/0025673 A1 * 2/2004 Davis ..... 84/719

FOREIGN PATENT DOCUMENTS

JP H1-47798 10/1989
JP H2-64992 5/1990

* cited by examiner

*Primary Examiner*—Ross Gushi
(74) *Attorney, Agent, or Firm*—Morrison & Foerster LLP

(57) ABSTRACT

A keyboard apparatus which is capable of enhancing key touch feeling. The keyboard apparatus has a chassis (1), and key bodies (10) to be depressed are supported by the chassis. A hammer body (20) associated with each of the key bodies is driven by the key body via engagement with the same to move in a key depressing direction to thereby impart an inertial force to the key body when the key is depressed. The state of engagement between the key body and the hammer body suddenly changes as the key depressing velocity changes across a predetermined key depressing velocity, such that when the key depressing velocity is higher than the predetermined key depressing velocity, the hammer body hardly moves in the key depressing direction, whereas when the key depressing velocity is not higher than the predetermined key depressing velocity, the hammer body moves in the key depressing direction.

18 Claims, 16 Drawing Sheets

KEYBOARD APPARATUS

BACKGROUND OF THE INVENTION

1. Field of the Invention

The present invention relates to a keyboard apparatus in which an arm is driven by a key to move to thereby apply an inertial force to the key when the key is depressed.

2. Description of the Related Art

Conventionally, a keyboard apparatus is known in which arms having mass are provided such that each of the arms moves e.g. pivotally in accordance with depression of the associated key so as to improve key touch feeling.

For example, a keyboard apparatus disclosed in Japanese Laid-Open Utility Model Publication (Kokai) No. H02-64992 is configured such that an arm provided with a weight is pivotally disposed on a slide member which slides in accordance with key depression, so as to transmit displacement of the associated key which is depressed to the slide member. When the key is depressed, in the first half of the key depression stroke, the associated arm is driven by the key, for pivotal motion, but halfway in the key depression stroke, the key is disengaged from the arm by a sliding motion of the slide member, and the pivotal motion of the arm is stopped. Consequently, from then on, the load of the arm is not applied to the key.

Further, a keyboard apparatus disclosed in Japanese Patent No. 3221283 is configured such that a driving part of a key and a driven part of the associated pivotally movable arm (mass body) are constantly held in engagement with each other, and in a key depression stroke, an inertial force of the arm is imparted to the key via the driving part and the driven part.

Furthermore, conventionally, keyboard apparatuses have been proposed in which touch feeling (hereinafter referred to as "key touch feeling") can be changed. For example, in a keyboard apparatus proposed in Japanese Patent Publication (Kokoku) No. H01-47798, an arm having one end thereof engaged with a key and the other end thereof provided with a weight is configured such that the arm can be driven by the key via the one end in accordance with key depression, for pivotal motion about a support member. Further, the position of the other end of the arm can be adjusted within a range between an upper limit position and a lower limit position. When the position of the other end is set to the lower limit position, the arm is allowed to pivotally move about the support member in accordance with key depression, but when the position of the other end is set to the upper limit position, the other end cannot come into contact with the support member, so that no pivotal motion of the arm about the support member occurs. Thus, the weight of key touch feeling can be changed according to a position set for the other end of the arm.

In general, from the viewpoint of realizing expressive performance by a keyboard apparatus, it is considered desirable that an inertial force acts relatively lightly during strong key depression, i.e. when a key is quickly depressed, and acts relatively heavily during weak key depression, i.e. when a key is slowly depressed. However, in Japanese Laid-Open Utility Model Publication (Kokai) No. H02-64992, the key is always disengaged from the arm at a predetermined position in the key depression stroke, so that the same load is applied to the key in the same range of the key stroke irrespective of the intensity of the key depression. Further, in Japanese Patent No. 3221283, since the driving part of the key and the driven part of the arm are constantly held in engagement with each other, the same load is applied to the key in the same range of the key stroke irrespective of the intensity of key depression.

Therefore, these conventional keyboard apparatuses leave room for improvement in enhancement of key touch feeling in consideration of key depression intensity.

In Japanese Patent Publication (Kokoku) No. H01-47798, one end of the arm is constantly held in contact with the associated key, and besides, the arm also has mass in other parts than the weight. For this reason, even when the other end of the arm is at the upper limit position and the arm is kept from contact with the support member, the arm moves along with the key, and hence not a little inertial force generated by the motion of the arm is constantly applied to the key. Therefore, there is a limit to a setting for making key touch feeling light, and there still remains room for further improvement in changing key touch feeling distinctly and over a wide range.

SUMMARY OF THE INVENTION

It is a first object of the present invention to provide a keyboard apparatus which is capable of enhancing key touch feeling.

It is a second object of the present invention to provide a keyboard apparatus which allows switching of impartment/non-impartment of an inertial force to keys and adjustment of the inertial force to be imparted, thereby making it possible to change key touch feeling distinctly and over a wide range.

To attain the above first object, in a first aspect of the present invention, there is provided a keyboard apparatus comprising a support member, a plurality of keys that are supported by the support member, for key depressing operations, and an arm that is driven by an associated one of the keys via engagement with the associated key to move in a key depressing direction to thereby impart an inertial force to the associated key when the key is depressed, wherein the associated key is disposed for driving engagement with the arm such that a state of engagement between the associated key and the arm suddenly changes as a depressing velocity of the key changes across a predetermined key depressing velocity, such that when the depressing velocity of the key is higher than the predetermined key depressing velocity, the arm hardly moves in the key depressing direction, and when the depressing velocity is not higher than the predetermined key depressing velocity, the arm moves in the key depressing direction.

With the arrangement of the first aspect of the present invention, it is possible to make the touch feeling lighter in strong key depression than in weak key depression, thereby enhancing key touch feeling.

Preferably, the arm is movable in the key depressing direction and a predetermined direction different from the key depressing direction, and the associated key is disposed for driving engagement with the arm such that as the depressing velocity of the key is higher, motion of the arm in the predetermined direction has a higher priority over motion of the arm in the key depressing direction.

Preferably, wherein the driving engagement of the associated key with the arm is set such that driving of the key by the arm terminates during a depressing stroke of the key.

More preferably, the keyboard apparatus comprises a pivotal member that has one part thereof supported by the support member, and another part thereof pivotally movable about the one part, the other part having a pivot, and the arm and the pivotal member are disposed relative to each other such that the arm is pivotally movable about the pivot of the other part of the pivotal member, and the motion of the arm in the predetermined direction is realized by pivotal motion of the other part of the pivotal member about the one part.

More preferably, the keyboard apparatus comprises a biasing device that biases the arm in an opposite direction to the predetermined direction, and a restricting device that defines an initial position of the arm in the predetermined direction.

To attain the above first object, in a second aspect of the present invention, there is provided a keyboard apparatus comprising a support member, a plurality of keys that are supported by the support member, for key depressing operations, and an arm that is driven by an associated one of the keys to move in a key depressing direction to thereby impart an inertial force to the associated key when the key is depressed, wherein the associated key is disposed for driving engagement with the arm such that when a depressing velocity of the key is higher, an amount of motion of the arm in the key depressing direction is smaller than when the depressing velocity of the key is lower.

With the arrangement of the second aspect of the present invention, it is possible to make the touch feeling lighter in the strong key depression than in the weak key depression, thereby enhancing key touch feeling.

To attain the above first object, in a third aspect of the present invention, there is provided a keyboard apparatus comprising a support member, a plurality of keys that each have a driving part and are supported by the support member, for key depressing operations, an arm that has a driven part driven by the driving part of an associated one of the keys via engagement with the driving part of the associated key, the arm being movable in a key depressing direction by a key depressing force transmitted from the associated key through a frictional force generated by the engagement between the driven part and the driving part of the associated key when the driven part is driven by the driving part, to thereby impart an inertial force to the associated key when the key is depressed, wherein the associated key is disposed for driving engagement with the arm such that when the frictional force increases, the frictional force is relieved.

With the arrangement of the third aspect of the present invention, when the frictional force is relieved, the key depressing force transmitted from the key to the arm associated therewith is reduced. Therefore, e.g. by facilitating the escape of the frictional force in the strong key depression rather than in the weak key depression, it is possible to make the touch feeling lighter in the strong key depression than in the weak key depression.

Preferably, the associated key is disposed for driving engagement with the arm such that when the key depressing force transmitted from the associated key to the arm is not larger than a predetermined force, the engagement between the driven part and the driving part causes a static frictional state therebetween, whereas when the key depressing force transmitted from the associated key to the arm is not smaller than the predetermined force, the engagement between the driven part and the driving part causes a dynamic frictional state therebetween, and the frictional force is relieved when the static frictional state caused by the engagement between the driven part and the driving part is changed into the dynamic frictional state during an increase in the frictional force.

More preferably, the arm is movable in the key depressing direction and a predetermined direction different from the key depressing direction, and the associated key is disposed for driving engagement with the arm such that when the engagement between the driven part and the driving part causes the static frictional state, the arm mainly moves in the key depressing direction, whereas when the engagement between the driven part and the driving part causes the dynamic frictional state, the arm moves in the predetermined direction and hardly moves in the key depressing direction.

Further preferably, at least one of the driving part of the associated key and the driven part of the arm has a sloping surface part which is not parallel to the key depressing direction and the predetermined direction different from the key depressing direction, and the associated key is disposed for driving engagement with the arm such that the key depressing force is distributed in the key depressing direction and the predetermined direction according to an inclination angle of the sloping surface part, whereby the arm is made movable in the key depressing direction and the predetermined direction.

To attain the above second object, in a fourth aspect of the present invention, there is provided a keyboard apparatus comprising a support member, a plurality of keys that each have a driving part and are supported by the support member, for key depressing operations within a pivotal range thereof from a key-released state to a key-depressed state, a key return device that constantly operates to return an associated one of the keys toward the key-released state within the pivotal range of the associated key, an arm that has a driven part driven by the driving part of the associated key via engagement with the driving part of the associated key, the arm being pivotally moved when the driven part is driven by the driving part of the associated key, to thereby impart an inertial force to the associated key when the key is depressed, a switching device that switches between a first state where the driven part of the arm is driven by the driving part of the associated key during at least part of a forward key depression stroke, and a second state where the driven part of the arm is never driven by the driving part of the associated key through an entire key depression stroke, and an adjusting device that adjusts a degree of the engagement between the driven part and the driving part in the first state.

With the arrangement of the fourth aspect of the present invention, it is possible to switch the impartment/non-impartment of the inertial force to the key and adjust the inertial force to be imparted, thereby changing key touch feeling distinctly and over a wide range.

Preferably, the arm is displaceable in a predetermined direction containing a component perpendicular to a direction of pivotal motion of the arm, and the switching device displaces the arm in the predetermined direction to thereby switch between the first state and the second state.

More preferably, the arm comprises a plurality of the arms associated with respective ones of the plurality of keys, and the switching device collectively displaces the plurality of arms in the predetermined direction.

Preferably, the arm is displaceable in a predetermined direction containing a component perpendicular to a direction of pivotal motion of the arm, and the adjusting device adjusts the degree of the engagement between the driven part and the driving part in the first state by displacing the arm in the predetermined direction.

Preferably, the associated key is disposed for driving engagement with the arm such that in the first state, driving of the driven part by the driving part terminates halfway during the forward key depression stroke of the associated key, and timing in which the driving of the driven part by the driving part terminates during the forward key stroke is changed by the adjusting device adjusting the degree of the engagement between the driven part and the driving part.

Preferably, the arm comprises a plurality of the arms associated with respective ones of the plurality of keys, and the adjusting device is provided for each of the arms, for adjustment of the degree of the engagement between the driven part of the arm and the driving part of an associated one of the keys.

More preferably, the keyboard apparatus comprises a pivotal member that has one part thereof supported by the support member, and another part thereof pivotally movable about the one part, the other part having a pivot, and the arm and the pivotal member are disposed relative to each other such that the arm is pivotally movable about the pivot of the other part of the pivotal member, and the motion of the arm in the predetermined direction is realized by pivotal motion of the other part of the pivotal member about the one part.

Preferably, the keyboard apparatus comprises a return biasing device that is disposed for contact with an associated one of the keys in the key-depressed state to thereby set a key depression end position of the associated key, and wherein when the return biasing device is in contact with the associated key, the return biasing device biases the associated key toward the key-released state.

The above and other objects, features, and advantages of the present invention will become more apparent from the following detailed description taken in conjunction with the accompanying drawings.

BRIEF DESCRIPTION OF THE DRAWINGS

FIGS. 4A and 4B are front views of essential parts and elements of the initial position adjusting mechanism in FIG. 3, in which:

FIG. 4A shows a collective adjustment part; and

FIG. 4B shows an individual adjustment part;

FIGS. 5A to 5D are side views of the keyboard apparatus in a state where a key is weakly depressed in an "acoustic piano setting", in which:

FIG. 5A shows a non-key-depressed state;

FIG. 5B shows a state where a weight of a hammer body has approached the lower surface of a key body;

FIG. 5C shows a state where a pivot arm has pivotally moved in a counterclockwise direction as viewed in the figure; and FIG. 5D shows a state where the key body has returned to its initial position;

FIGS. 6A to 6M are schematic views showing the relationship between a key depressing force, a vertical resisting force, and a frictional force in a state where the key is strongly depressed in the "acoustic piano setting", in which:

FIGS. 6A, 6D, 6G, 6J, and 6M shows changes with time in interaction between the key body and the hammer body;

FIGS. 6B, 6E, 6H, and 6K correspond to FIGS. 6A, 6D, 6G, and 6J, respectively, and show the relationship between the vertical resisting force and the frictional force which are generated by a sloping surface part against the key depressing force; and FIGS. 6C, 6F, 6I, and 6L correspond to FIGS. 6A, 6D, 6G, and 6J, respectively, and show-the relationship between horizontal component forces and vertical component forces, which are applied to the sloping surface part in response to the vertical resisting force and the frictional force;

FIGS. 7A to 7D are side views of the keyboard apparatus in a state where the key is strongly depressed in the "acoustic piano setting", in which:

FIG. 7A shows a non-key-depressed state;

FIG. 7B shows a state in a stage well before termination of key depression;

FIG. 7C shows a key depression end state of the key body; and

FIG. 7D shows s state where the key body has returned to its initial position;

FIGS. 8A to 8D are side views of the keyboard apparatus in an "organ setting", in which:

FIG. 8A shows a non-key-depressed state;

FIG. 8B shows a state in a stage well before termination of key depression;

FIG. 8C shows a key depression end state of the key body; and

FIG. 8D shows a state where the key body has returned to the non-key-depressed state position;

FIGS. 9A to 9D are schematic views showing a driving part and a driven part according to a variation 1 of the first embodiment, in which:

FIG. 9A shows a static frictional state between the driving part and the driven part;

FIG. 9B shows a static frictional state between the driving part and the driven part;

FIG. 9C shows a dynamic frictional state between the driving part and the driven part; and FIG. 9D shows a state where the driving part has been disengaged from the driven part;

FIGS. 10A to 10H are schematic views showing a driving part and a driven part according to a variation 2 of the first embodiment, in which:

FIG. 10A shows an initial state in key depression;

FIG. 10B shows a limit state where a moment MA can be barely balanced with a moment MB;

FIG. 10C shows a state where the moment MA has exceeded the moment MB; and

FIG. 10D shows a state where the driving part has been disengaged from a roller;

FIGS. 10E to 10H are schematic views showing a driving part and a driven part according to a variation 3 of the first embodiment, in which:

FIG. 10E shows an initial state in key depression;

FIG. 10F shows a limit state where a moment MD can be barely balanced with a moment MC;

FIG. 10G shows a state where the moment MD has exceeded the moment MC; and

FIG. 10H shows a state where the driving part has been disengaged from the driven part;

FIGS. 11A to 11D are schematic views showing a driving part and a driven part according to a variation 4 of the first embodiment, in which:

FIG. 11A shows an initial state in key depression;

FIG. 11B shows a key depression end state;

FIG. 11C shows a key-released state; and

FIG. 11D shows a further variation of the present variation;

FIGS. 14A to 14C are views showing component parts and elements of the keyboard apparatus in FIG. 13, in which:

FIG. 14A is a side view showing details of an initial position adjusting mechanism of the keyboard apparatus according to the second embodiment;

FIG. 14B is a perspective view of a driven part; and

FIG. 14C is a schematic view showing the driven part and a hammer driving part in side view.

DETAILED DESCRIPTION OF THE PREFERRED EMBODIMENTS

The present invention will now be described in detail with reference to the drawings showing preferred embodiments thereof.

Figure 1:
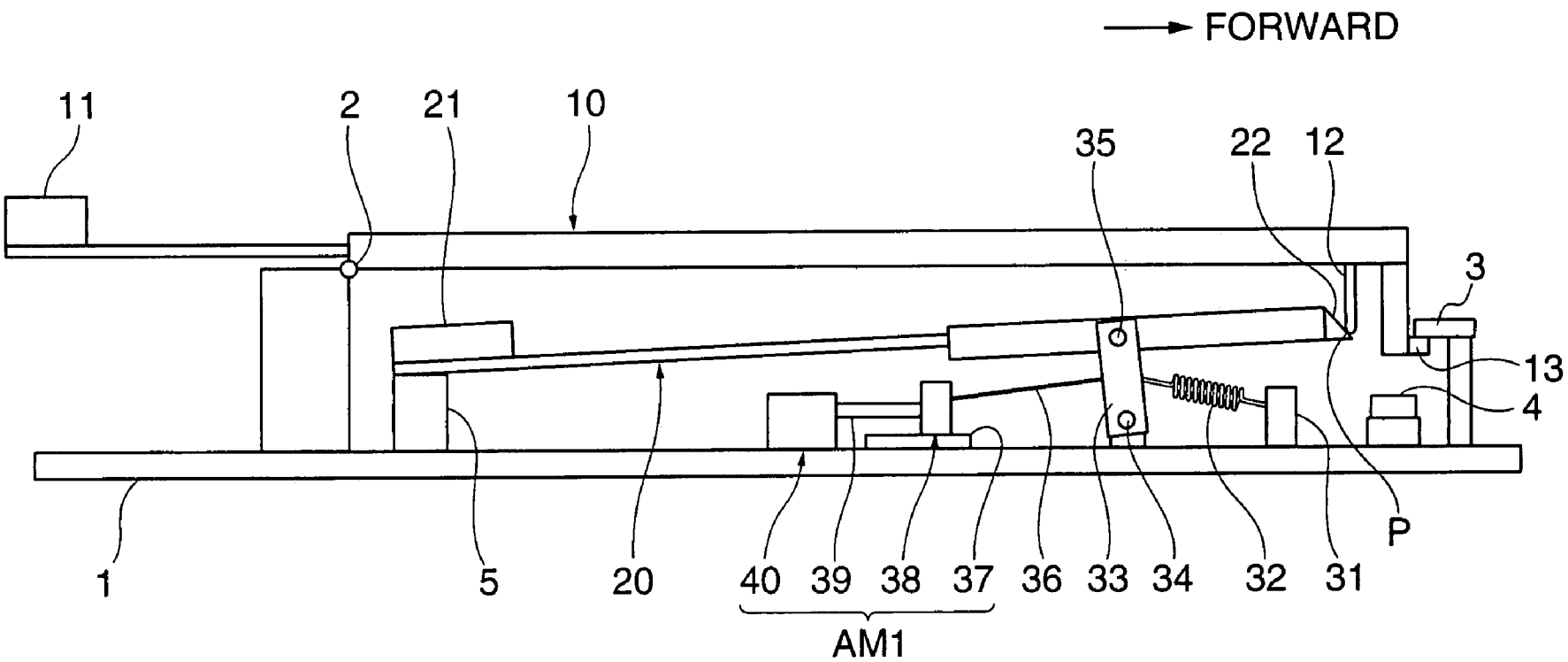
FIG. 1 is a side view of a-keyboard apparatus according to a first embodiment of the present invention.

FIG. 1 is a side view of a keyboard apparatus according to a first embodiment of the present invention. The keyboard apparatus of the present embodiment has a chassis 1 on which are supported key bodies 10 (a white key is shown in FIG. 1 by way of example) to be depressed, hammer bodies 20 each for applying a moderate inertial force to a key body 10 associated therewith during key depression, and so forth, such that they can perform vertical swinging motion. Hereafter, the free end side (right side as viewed in FIG. 1) of the key body 10 will be referred to as "the front".

The key body 10 has a rear end part thereof supported such that the key body 10 can perform vertical pivotal motion about a key pivot 2. The key body 10 has a weight 11 provided on a rearmost part thereof rearward of the key pivot 2, and the weight 11 constantly urges, due to its own weight, the key body 10 in a counterclockwise direction as viewed in FIG. 1 (i.e. in the opposite direction to the key depressing direction). A stopper contact part 13 extends downward from a lower part of the front end of the key body 10. A hammer driving part 12 for driving the hammer body 20 extends downward from a lower part of the key body 10 at a location slightly rearward of the stopper contact part 13. The lower end of the hammer driving part 12 is formed in an arcuate shape in cross section (see e.g. FIG. 6A).

An upper limit stopper 3 and a key-on switch 4 formed of an elastic material are disposed at respective locations on the chassis 1 corresponding to the stopper contact part 13 of the key body 10. The key-on switch 4 may be implemented by an optical switch for detecting light. In a non-key-depressed state (key-released state), the stopper contact part 13 is held in contact with the upper limit stopper 3 due to the weight of the weight 11, to thereby define a non-depressed position (i.e. a key stroke initial position) of the key body 10 as shown in FIG. 1. On the other hand, during key depression, the stopper contact part 13 is brought into contact with the key-on switch 4 by full depression of the key body 10, to thereby define a key stroke end position of the key body 10. At this time, the key depression is detected by the key-on switch 4. It should be noted that a lower limit stopper may be provided on the chassis 1 so as to prevent the key-on switch 4 from being crushed.

The hammer bodies 20 are provided in a one-to-one correspondence with the key bodies 10, and each of the hammer bodies 20 is supported such that it can perform vertical pivotal motion about an upper pivot 35 of a pivot arm 33, described in detail hereinafter. The hammer body 20 has a weight 21 disposed on a rearmost end part thereof, and most of the mass of the hammer body 20 is concentrated on the weight 21. The weight 21 constantly urges, due to its own weight, the hammer body 20 in the counterclockwise direction as viewed in FIG. 1. The hammer body 20 has a foremost end part thereof formed with a sloping surface part 22 facing obliquely forward and upward. As described hereinafter, this sloping surface part 22 functions as a driven part driven by the hammer driving part 12 of the key body 10.

A hammer lower limit stopper 5 is provided on the chassis 1, at a location approximately corresponding to the weight 21 of the hammer body 20. In predetermined states, described hereinafter, including the non-key-depressed state, a free end part (rearmost end) of the hammer body 20 is held in contact with the hammer lower limit stopper 5 due to the weight of the weight 21, to thereby define a pivotal stroke initial position of the hammer body 20 as shown in FIG. 1.

As described in detail hereinafter, due to engagement of the hammer driving part 12 of the key body 10 with the sloping surface part 22 of the hammer body 20, the hammer body 20 pivotally moves in a key depressing direction (i.e. a clockwise direction as viewed in FIG. 1) according to depression of the associated key body 10. The engagement relationship between the hammer driving part 12 and the sloping surface part 22 can be changed by an initial position adjusting mechanism AM1, described in detail hereinafter, which makes it possible to change key touch feeling.

Figure 2:
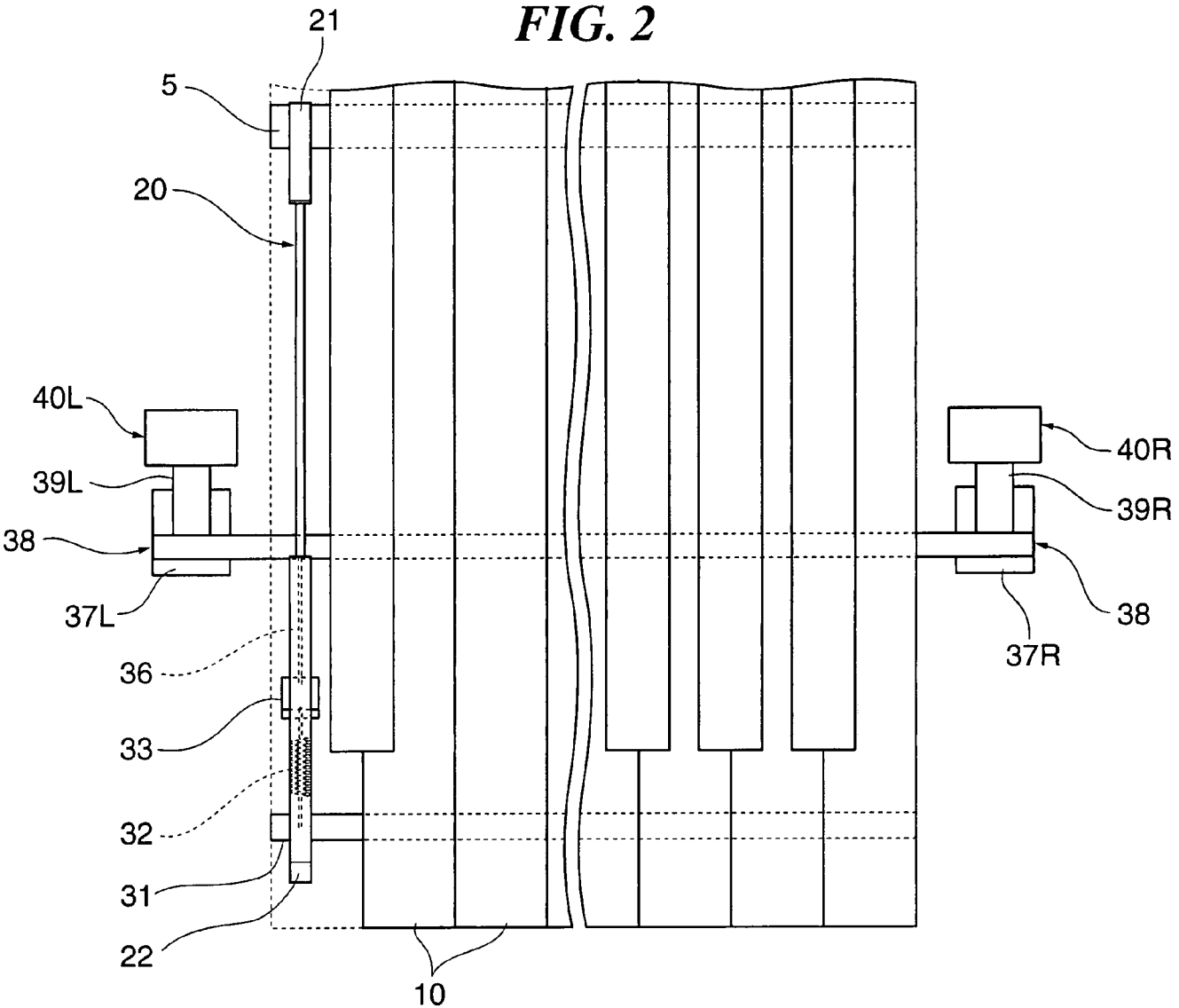
FIG. 2 is a fragmentary plan view of the keyboard apparatus.
Figure 3:
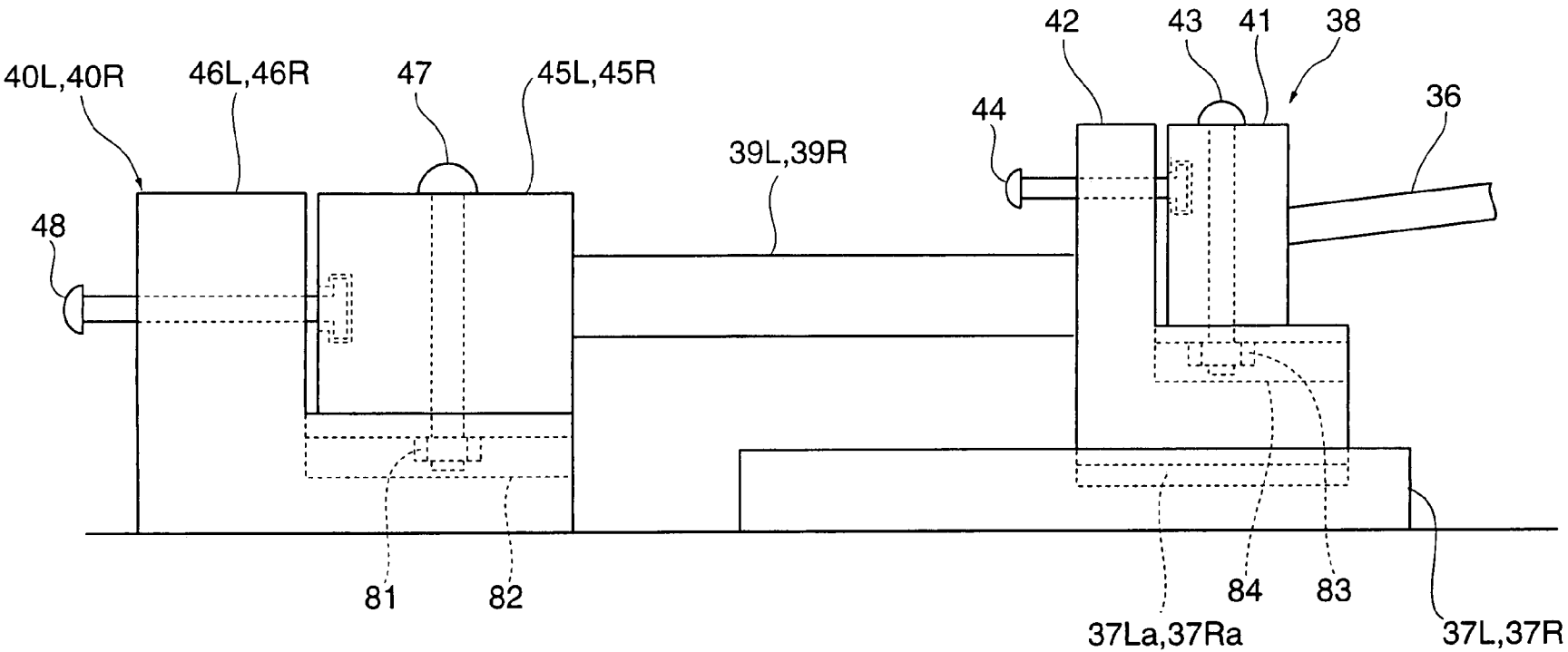
FIG. 3 is a side view of an initial position adjusting mechanism appearing in FIG. 1.

FIG. 2 is a fragmentary plan view of the keyboard apparatus of the present embodiment. FIG. 3 is a side view of the initial position adjusting mechanism AM1. FIG. 2 shows the arrangement of the keyboard apparatus corresponding to a predetermined number of octaves (two octaves in the present embodiment).

As shown in FIGS. 1 and 2, a lower pivot 34 is fixedly disposed on the chassis, and the pivot arm 33 pivotally moves about the lower pivot 34 in the clockwise and counterclockwise directions as viewed in FIG. 1. A spring engaging part 31 is disposed on the chassis 1 at a location forward of the pivot arm 33, and a front part of the pivot arm 33 and the spring engaging part 31 are connected to each other by a spring 32. The pivot arm 33 and the spring 32 are provided in a one-to-one correspondence with each key body 10. The spring 32 constantly pulls the pivot arm 33 in the clockwise direction as viewed in FIG. 1. In the present embodiment, only one spring engaging part 31 is commonly provided for the two-octave key bodies 10, but separate spring engaging parts 31 may be provided for the respective key bodies 10.

The initial position adjusting mechanism AM1 is disposed on the chassis 1 at a location rearward of the pivot arm 33. A thread 36 low in resilience has one end thereof attached to a rear part of the pivot arm 33, and the other end thereof connected to a part (described hereinafter) of the initial position adjusting mechanism AM1. The initial position adjusting mechanism AM1 is commonly provided for the two-octave key bodies 10. The thread 36 is provided for each of the key bodies 10.

Although in the present embodiment, the initial position adjusting mechanism AM1 and the spring engaging part 31 are provided for the two-octave key bodies 10, this is not limitative, but they may be provided for every three or more key bodies 10, or commonly provided for all the key bodies 10.

The initial position adjusting mechanism AM1 is comprised of slide bases 37 (37L and 37R), an individual adjustment part 38, connecting members 39 (39L and 39R), and collective adjustment parts 40 (40L and 40R). As shown in FIG. 2, the slide bases 37L and 37R, the connecting members 39L and 39R, and the collective adjustment parts 40L and 40R are symmetrically arranged on the respective left and right sides of the two-octave key bodies 10, and each pair on the opposite sides are identical in construction. Hereafter, when it is not required to distinguish between the left and right parts, the characters "L" and "R" are omitted from the reference numerals, and the parts are simply referred to as the slide base(s) 37, the connecting member(s) 39, and the collective adjustment part(s) 40, respectively.

Figure 4A:
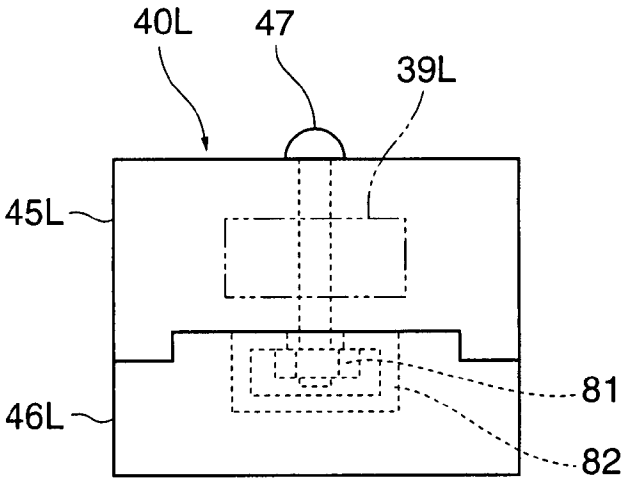
Figure 4B:
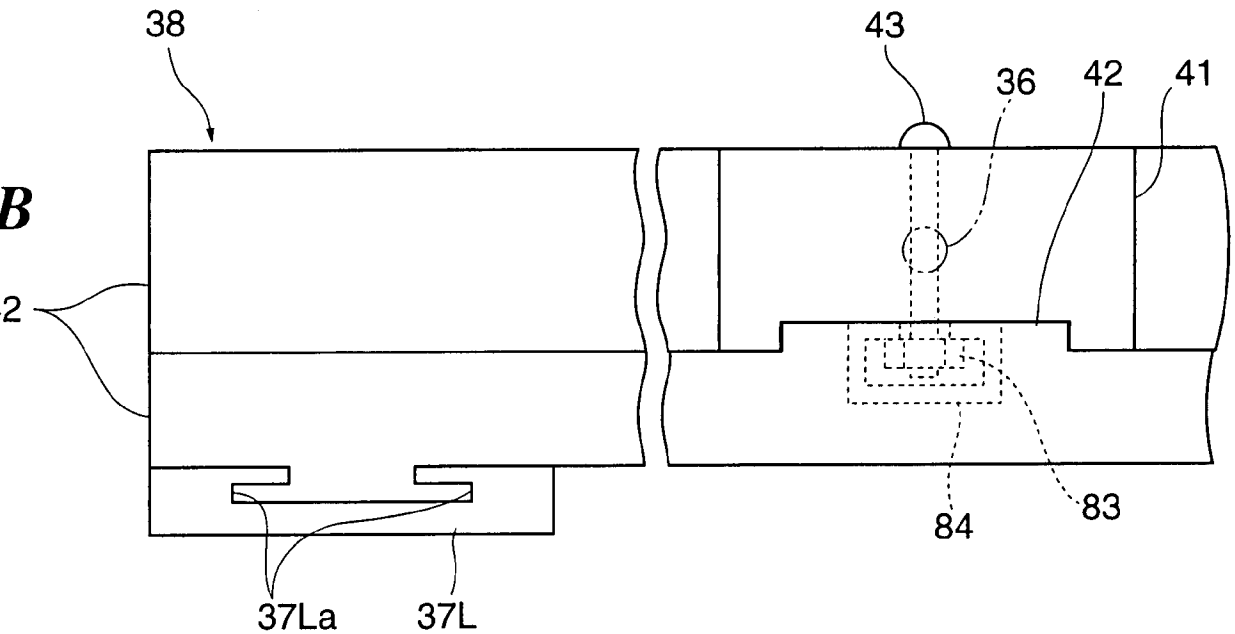

FIG. 4A is a front view of the collective adjustment part 40L, and FIG. 4B a front view of the individual adjustment part 38. The initial position adjusting mechanism AM1 is symmetrical in construction, and hence in the following, a description will be basically given of the left side in FIG. 2.

As shown in FIGS. 3 and 4A, the collective adjustment part 40L is comprised of a fixed member 46L having an L-shape in side view, and a collective adjustment slide member 45L supported on the fixed member 46L in a manner slidable forward and rearward. The fixed member 46 has an adjusting screw 48 mounted through a rear part thereof, and the position of the collective adjustment slide member 45 relative to the fixed member 46 in a longitudinal direction (a front-rear direction) can be adjusted by screwing in and out the adjusting screw 48. Further, the collective adjustment slide member 45 can be fixed to the fixed member 46 by a fixing screw 47. The fixed member 46 has a C channel-shaped guide member 82 embedded therein. A nut 81 is internally mounted in the guide member 82, and has a lower end of the fixing screw 47 screwed therein.

On the other hand, as shown in FIGS. 3 and 4B, the individual adjustment part 38 is comprised of a common slide member 42 having an L-shape in side view, and individual slide members 41. The common slide member 42 is commonly provided for the two-octave key bodies 10, while the individual slide members 41 are provided in a one-to-one correspondence with the key bodies 10.

The common slide member 42 is bridged between the slide bases 37L and 37R. The slide base 37L (37R) is formed therein with a guide groove 37La (37Ra) having a generally C-shaped cross-section, and a portion of the common slide member 42 associated with the guide groove 37La (37Ra) is formed in a shape fittable in the guide groove 37La (37Ra). Thus, the common slide member 42 is allowed to slide along the guide grooves 37La and 37Ra on the slide bases 37L and 37R in the longitudinal direction. Further, the individual slide members 41 are each allowed to slide on the common slide member 42 in the longitudinal direction.

The common slide member 42 has adjusting screws 44 mounted through a rear part thereof, and the position of each of the respective associated individual slide members 41 relative to the common slide member 42 in the longitudinal direction can be adjusted by screwing in and out the adjusting screw 44. Further, each of the individual slide members 41 can be fixed to the common slide member 42 by an associated fixing screw 43. The common slide member 42 has C channel-shaped guide members 84 embedded therein. A nut 83 is internally mounted in each of the guide members 84, and has a lower end of the associated fixing screw 43 screwed therein.

As shown in FIGS. 2 and 3, the front end of the collective adjustment slide member 45L (45R) and a corresponding portion of the rear end of the common slide member 42 are connected to each other by the connecting member 39L (39R). The connecting member 39 is formed of a material, such as a metal or a resin, which is less elastically-deformable than rubber or the like, or has no elastically-deformable property. Accordingly, the collective adjustment slide member 45 and the common slide member 42 connected thereto by the connecting member 39 are slid in unison for key touch feeling adjustment. The thread 36 is connected to the front end of an associated one of the individual slide members 41.

The pivot arm 33 is constantly pulled by the associated spring 32 in the clockwise direction as viewed in FIG. 1, as described hereinabove, so that in the non-key-depressed state, the position or posture of the pivot arm 33 is maintained with the thread 36 held in a tensed (stretched) state. Therefore, insofar as the non-key-depressed state is concerned, the position of the pivot arm 33 in the direction of pivotal motion thereof is determined by the position of the associated individual slide member 41, and the position of the associated hammer body 20 in the longitudinal direction is also determined at the same time. The positions of the pivot arm 33 and the hammer body 20 in the non-key-depressed state are also simply referred to as the "initial position(s)".

With this arrangement, the initial position of each of the hammer bodies 20 is adjusted by "collective adjustment" and/or "individual adjustment" by the initial position adjusting mechanism AM1.

First, the collective adjustment will be described with reference to FIG. 3. The fixing screw 47 is loosened and the collective adjustment slide member 45 is brought into contact with the front end of the adjusting screw 48. In this state, the position of the adjusting screw 48 is adjusted to slide the collective adjustment slide member 45 on the fixed member 46. As the collective adjustment slide member 45 is slid, the connecting members 39 and the individual adjustment part 38 are slid. When the collective adjustment slide member 45 is moved to a desired position, the fixing screw 47 is screwed to fix the collective adjustment slide member 45 to the fixed member 46. Thus, the initial positions of the respective hammer bodies 20 associated with the two-octave key bodies 10 can be collectively adjusted.

On the other hand, the individual adjustment is performed as follows: As in the relationship between the fixed member 46 and the collective adjustment slide member 45, a fixing screw 43 associated with a hammer body 20 to be adjusted is loosened and the associated individual adjustment slide member 41 is brought into contact with the front end of the associated adjusting screw 44. In this state, the position of the adjusting screw 44 is adjusted to slide the individual adjustment slide member 41 on the common slide member 42. When the individual adjustment slide member 41 is moved to a desired position, the fixing screw 43 is screwed to fix the individual adjustment slide member 41 to the common slide member 42. Thus, the initial positions of the hammer bodies 20 associated with the respective key bodies 10 can be individually adjusted.

Next, a description will be given of the operations of a key body 10 and that of the associated hammer body 20. The operations of these members vary not only depending on a key touch style, i.e. key depressing velocity or key depression intensity, but also depending on the setting of the initial position of the hammer body 20.

The setting of the position of the hammer body 20 in the longitudinal direction is roughly classified into two types, i.e. one setting (hereinafter referred to as "the acoustic piano setting") in which the driving part 12 of the key body 10 is engaged with the sloping surface part 22 of the hammer body 20 (first state), as shown in FIG. 1, during at least a part of the key depression stroke and e.g. in the non-key-depressed state, and another setting (hereinafter referred to as "the organ setting") in which the driving part 12 and the hammer body 20 are constantly kept apart from each other without ever being engaged with each other during the entire key depression stroke (second state), as described hereinafter with reference to FIGS. 8A to 8D. In the "acoustic piano setting", the initial position of the hammer body 20 can be adjusted in a continuous or stepless manner. Insofar as the engagement state of the driving part 12 and the sloping surface part 22 is concerned, an intermediate state between the organ setting and the acoustic piano setting can be set as described hereinafter.

FIGS. 5A to 5D are side views of the keyboard apparatus in the case where slow key depression (hereinafter referred to as "the weak key touch") is performed, which show changes with time in the operations of the key body 10 and the hammer body 20. FIGS. 6A to 6M are schematic views showing the relationship between a key depressing force, a vertical resisting force, and a frictional force in "the acoustic piano setting" and in the weak key touch. FIGS. 7A to 7D are side views of the keyboard apparatus in the case where quick key depression (hereinafter referred to as "the strong key touch") is performed, which show changes with time in the operations of the key body 10 and the hammer body 20.

Now, taking an acoustic piano as an example, the "weak key touch" is a key touch style corresponding to key depression intensities ranging from a very weak key depression intensity in which a hammer barely strikes the associated string to a relatively weak key depression intensity, and the "strong key touch" is a key touch style much stronger than the weak key touch and corresponding to key depression intensities ranging from a key depression intensity for normal sounding to a key depression intensity for strong sounding.

Figure 5A:
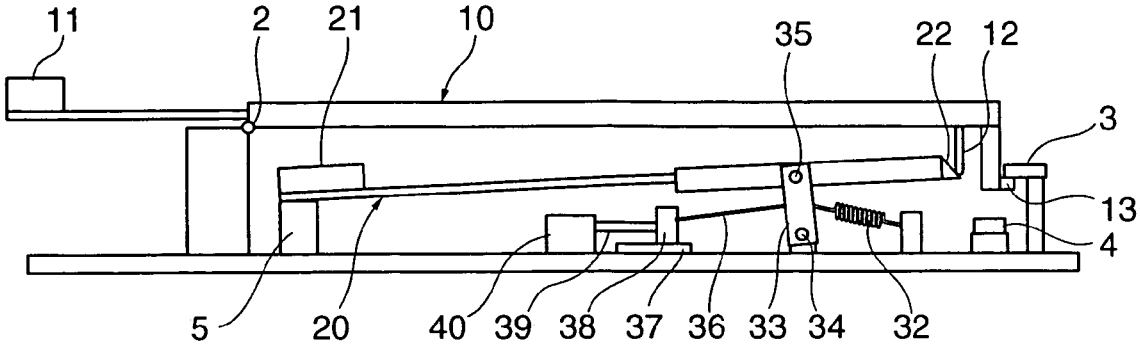
Figure 5B:
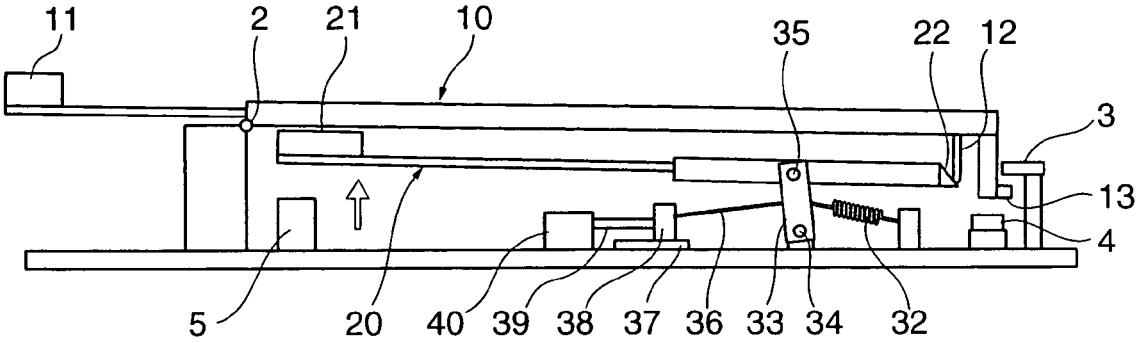

First, the weak key touch will be described. In the non-key-depressed state shown in FIG. 5A, the hammer driving part 12 of the key body 10 is in contact with the sloping surface part 22 of the hammer body 20, and therefore, as the key body 10 is slowly depressed, the hammer driving part 12 presses the sloping surface part 22 downward, whereby the hammer body 20 pivotally moves in unison with the motion of the key body 10. With this motion of the hammer body 20, the weight 21 of the hammer body 20 approaches the lower surface of the key body 10 as shown in FIG. 5B, with the hammer driving part 12 and the sloping surface part 22 being held in contact at a contact point P (see e.g. FIG. 6A). Therefore, during this time period, the hammer driving part 12 and the sloping surface part 22 are engaged with each other in a static frictional state, so that they hardly slide relative to each other, and hence the pivot arm 33 hardly moves, either.

More specifically, since the key body 10 pivotally moves about the key pivot 2, and the hammer body 20 about the upper pivot 35, if the pivot arm 33 does not pivotally move at all, the position of the pivot 35 does not change, and therefore the position of the key body 10 (hammer driving part 12) corresponding to the contact point P in the non-key-depressed state and that of the hammer body 20 (sloping surface part 22) do not draw the same pivotal locus. In other words, the pivotal loci of the two positions corresponding to the contact point P about the key pivot 2 and the pivot 35 in the non-key-depressed state progressively become away from each other as the key body 10 and the hammer body 20 pivotally move. However, as long as the hammer driving part 12 and the sloping surface part 22 are engaged with each other in a static frictional state, the pivot 35 is shifted in the forward direction by an amount for accommodating the difference between the two pivotal loci so as to keep the hammer driving part 12 and the sloping surface part 22 engaged together at the same contact point P, even though the amount of the shift is slight.

In the normal key touch styles including the weak key touch and the strong key touch, the pivotal motion of the hammer body 20 in the forward direction is stopped during the key depression before the weight 21 of the hammer body 20 is brought into contact with the lower surface of the key body 10. Therefore, in the present embodiment, there is not provided an upper limit stopper for abutment with the hammer body 20. This simplifies the construction of the keyboard apparatus and contributes to reduction of the thickness of the entire keyboard apparatus.

Figure 5C:
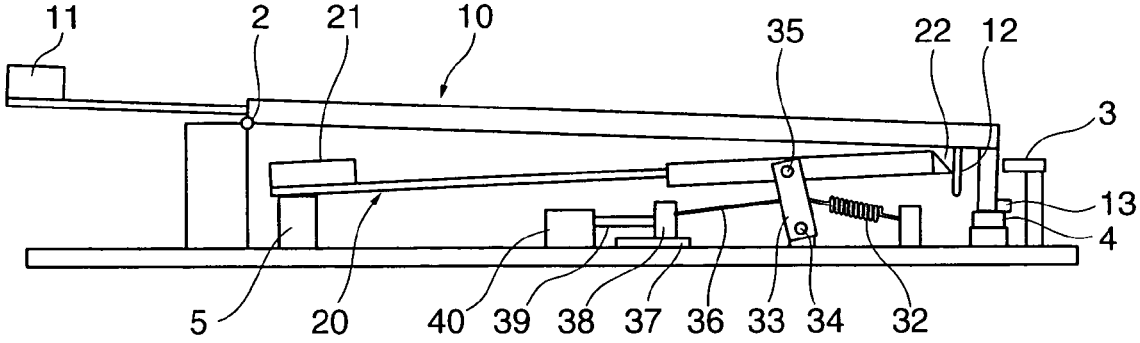

As described in detail hereinafter, after stoppage of the forward pivotal motion of the hammer body 20, the engagement between the hammer driving part 12 and the sloping surface part 22 changes into a dynamic frictional state and the pivot arm 33 pivotally moves in the counterclockwise direction as shown in FIG. 5C, the upper pivot 35 provided in the upper part of the pivot arm 33 shifts rearward, and the hammer body 20 is also shifted rearward (in a predetermined direction) in unison with the motion of the upper pivot 35. As a consequence, the hammer driving part 12 is disengaged from the sloping surface part 22, whereby a static let-off feeling like that provided by an acoustic piano can be obtained. Further, the stopper contact part 13 comes into contact with the key-on switch 4, whereby the key depression is detected, and the depression or forward stroke of the key body 10 is terminated.

After disengagement of the hammer driving part 12 from the sloping surface part 22, the hammer body 20 quickly moves in the counterclockwise direction with the front end (lower edge of the sloping surface part 22) thereof sliding on the rear wall of the hammer driving part 12, to bring the weight 21 into contact with the hammer lower limit stopper 5. At this time point, the hammer body 20 stands still at a position shifted slightly rearward from its originally set initial position. At this time, since the mass of the hammer body 20 is not applied to the key body 10, even if the key body 10 is continuously depressed, only the static load of the key body 10 is applied to the player's finger, so that the finger cannot be fatigued.

Figure 5D:
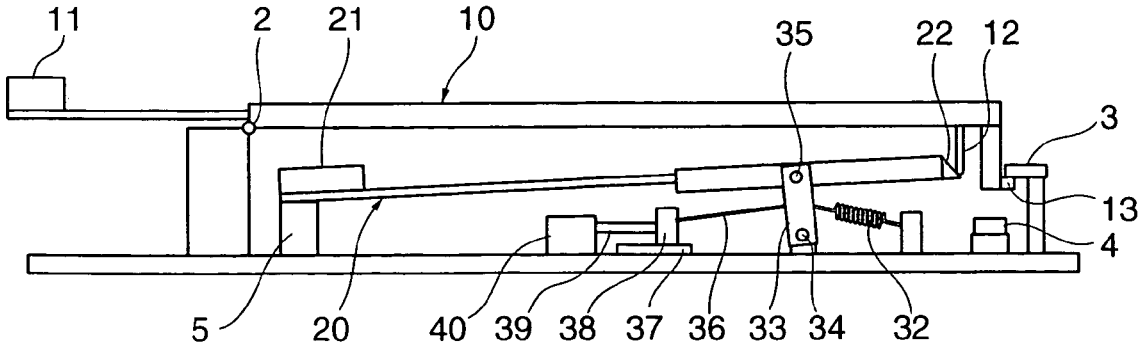

Thereafter, when released from the key depressing force, the key body 10 returns to its initial position as shown in FIG. 5D. On this occasion, the key body 10 receives not only the weight of the weight 11, but also an initial reaction force from the key-on switch 4, so that the key body 10 can quickly return to its initial position, which contributes to improvement of performance in repeated key striking. When the hammer driving part 12 returns to a position where its engagement with the sloping surface part 22 is allowed, by the return of the key body 10 to its initial position, the pivot arm 33 pivotally moves in the clockwise direction by the pulling or biasing force of the spring 32, whereby the hammer body 20 also returns to its initial position.

Next, the interaction between the hammer driving part 12 and the sloping surface part 22 in the weak key touch will be described with reference to FIGS. 6A to 6M. In FIGS. 6A to 6L, the key depressing force is represented by F, the vertical resisting force by N', and the frictional force by f'. FIGS. 6A, 6D, 6G, 6J, and 6M show changes with time in the interaction between the hammer driving part 12 and the sloping surface part 22. FIGS. 6B, 6E, 6H, and 6K correspond to FIGS. 6A, 6D, 6G, and 6J, respectively, and show the relationship between the vertical resisting force N' and the frictional force f' which are generated by the sloping surface part 22 against the key depressing force F. FIGS. 6C, 6F, 6I, and 6L correspond to FIGS. 6A, 6D, 6G, and 6J, respectively, and show the relationship between horizontal component forces and vertical component forces applied to the sloping surface part 22 in response to the vertical resisting force N' and the frictional force f'. In FIGS. 6A to 6M, the angle of the sloping surface part 22, the shape of the hammer driving part 12, and the magnitude of each force are shown in an exaggerated manner for purposes of ease of understanding.

Figure 6A:
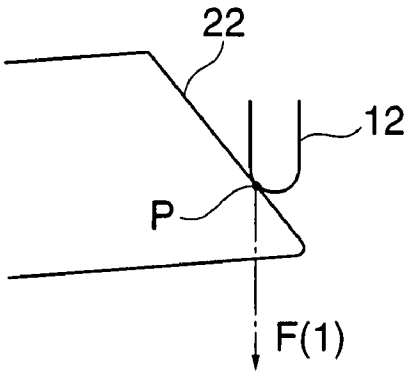
Figure 6B:
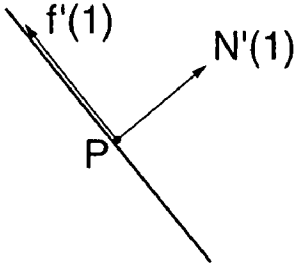
Figure 6C:
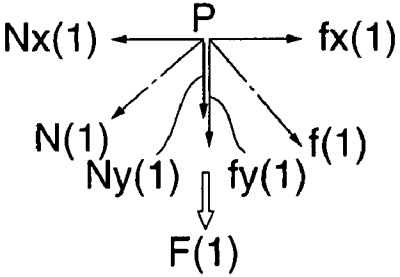

In FIGS. 6C, 6F, 6I and 6L, a horizontal component force and a vertical component force applied to the sloping surface part 22 in response to the vertical resisting force N' are represented by Nx and Ny, respectively, and a horizontal component force and a vertical component force applied to the sloping surface part 22 in response to the frictional force f' are represented by fx and fy, respectively. FIGS. 6A to 6C show the same state. Further, FIGS. 6D to 6F, 6G to 6I, and 6J to 6L show the respective same states. Hereafter, when the force groups in the respective states shown in FIGS. 6A to 6C, 6D to 6F, 6G to 6I, and 6J to 6L are to be distinguished from each other, parenthesized numbers (1) to (4) designating the respective states are added to the key depressing force F, the vertical resisting force N' and its reaction force N, the frictional force f' and its reaction force f, the horizontal component force Nx, the horizontal component force fx, the vertical component force Ny, and the vertical component force fy. For example, the key depressing force F and the frictional force f' in FIGS. 6A to 6C are expressed as the key depressing force F(1) and the frictional force f' (1).

Hereafter, the term "friction" used in considering the interaction is intended to mean "sliding friction". The hammer driving part 12 has an arcuate end, and hence, to be more precise, the hammer driving part 12 performs a rolling operation on the sloping surface part 22, which produces slight rolling friction. However, this rolling friction has little effect on the key touch-related action, and therefore the rolling friction will be ignored in considering the interaction.

Figure 6D:
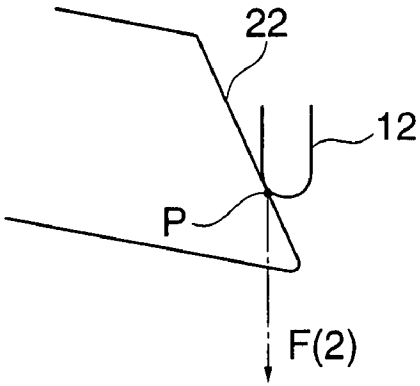
Figure 6E:
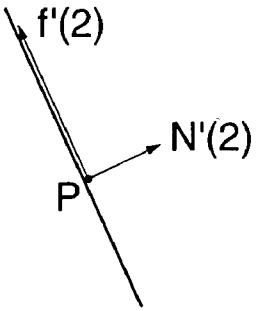
Figure 6F:
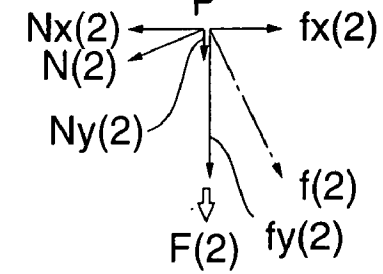
Figure 6G:
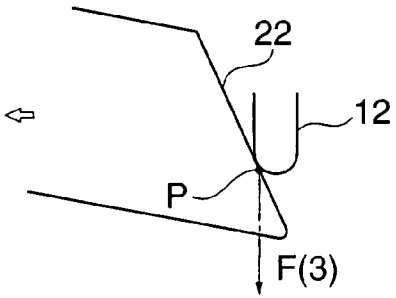
Figure 6H:
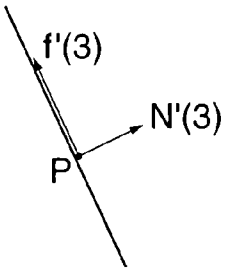
Figure 6I:
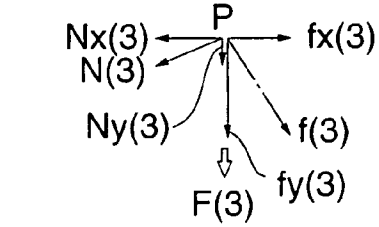
Figure 6J:
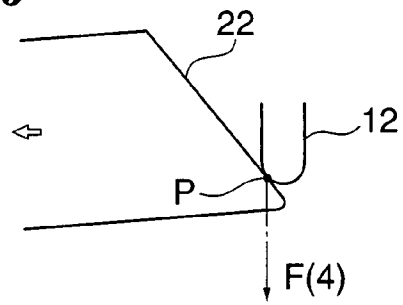
Figure 6K:
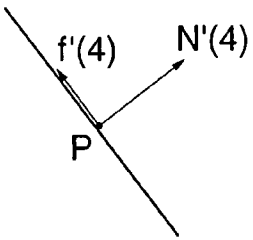
Figure 6L:
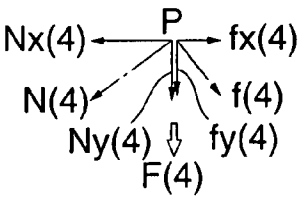
Figure 6M:
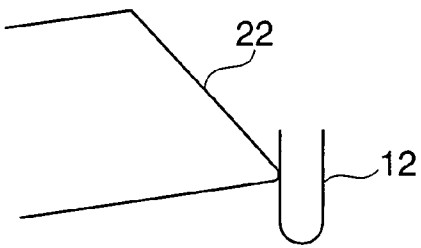

When the frictional state between the hammer driving part 12 and the sloping surface part 22 is compared between FIGS. 6A, 6D, 6G, 6J, and 6M, FIGS. 6A and 6D show a static frictional state, and FIGS. 6G and 6J show a dynamic frictional state. Therefore, a boundary separating between the static frictional state and the dynamic frictional state exists between FIG. 6D and FIG. 6G. FIGS. 6A and 6D correspond to the respective states shown in FIGS. 5A and 5B. FIG. 6M corresponds to the state shown in FIG. 5C.

First, as shown in FIG. 6A, in the initial stage of key depression, the downward key depressing force F(1) is applied by the hammer driving part 12 to the sloping surface part 22 at the contact point P between the hammer driving part 12 and the sloping surface part 22. The sloping surface part 22 is configured to cause moderate sliding friction, so that in the state shown in FIG. 6A, the static frictional state is maintained. Therefore, the key depressing force F(1) causes application of a vertical resisting force N' (1) perpendicular to the sloping surface part 22 and a frictional force f' (1) parallel to the same to the hammer driving part 12 at the contact point P (see FIG. 6B).

As shown in FIG. 6C, a force N(1) applied to the sloping surface part 22 (as a reaction force) in response to the vertical resisting force N' (1) is divided at the contact point P into a horizontal component force Nx(1) and a vertical component force Ny(1) which are applied to the sloping surface part 22. Further, a force f(1) applied to the sloping surface part 22 (as a reaction force) in response to the frictional force f' (1) is divided into a horizontal component force fx(1) and a vertical component force fy(1) which are applied to the sloping surface part 22. At this time point, since the static frictional state is maintained, the horizontal component force Nx(1) and the horizontal component force fx(1) cancel each other. Consequently, almost no substantial forces in the longitudinal direction act on the hammer body 20, and hence the hammer body 20 hardly moves in the longitudinal direction. On the other hand, in the vertical direction, the sum of the vertical component force Ny(1) and the vertical component force fy(1) (which sum is equal to the key depressing force F(1)) is applied to the sloping surface part 22, which causes pivotal motion of the hammer body 20.

The static frictional state is maintained until the hammer driving part 12 and the sloping surface part 22 enter the state shown in FIGS. 6D to 6F. The relationship between the respective actions of the forces in the state in FIGS. 6D to 6F is the same that in the state in FIGS. 6A to 6C. In the weak key touch, the player depresses the key body 10 such that the key body 10 pivotally moves at a substantially constant slow velocity, so that as long as the static frictional state is maintained, the key depressing force F is held substantially constant (i.e. F(1)=F(2)). However, since the inclination angle of the sloping surface part 22 progressively increases, the frictional force f' progressively increases (f' (1)<f' (2)). The state shown in FIG. 6D is a limit state where the static frictional state can barely be maintained, and here the frictional force f' (2) is equal to the maximum frictional force depending on the static friction coefficient.

When the key body 10 is further depressed from the state shown in FIG. 6D, since the frictional force f' cannot exceed the maximum frictional force, the sliding frictional state between the hammer driving part 12 and the sloping surface part 22 suddenly changes from the static frictional state into the dynamic frictional state (see FIG. 6G). In short, sliding occurs. Actually, immediately after the sliding starts to occur, the static frictional state and the dynamic frictional state may alternately take place at short time intervals in a repeated manner. The dynamic friction coefficient is smaller than the static friction coefficient, and hence the frictional force f' sharply decreases (i.e. f'(3)<f' (2)) (see FIG. 6H). As a consequence, the horizontal component force fx(3) becomes smaller than the horizontal component force Nx(3) (see FIG. 6I). Therefore, after transition to the dynamic frictional state, the hammer body 20 receives a rearward biasing force, and the pivot arm 33 pivotally moves in the counterclockwise direction to shift the hammer body 20 rearward.

Further, after the hammer body 20 starts rearward motion, although the key depressing force F is larger than in the static frictional state, the vertical component force fy decreases relative to the horizontal component force Nx, and consequently the rearward motion has priority over the pivotal motion in the key depressing direction. Then, when the weight of the weight 21 comes to exceed the vertical component force fy, the hammer body 20 ceases to perform forward pivotal motion, and starts backward pivotal motion (see FIGS. 6J to 6L). Thereafter, when the hammer driving part 12 is disengaged from the sloping surface part 22, the frictional state on the sloping surface part 22 disappears. Thus, the friction-based driving of the sloping surface part 22 by the hammer driving part 12 terminates, and as shown in FIG. 6M, the key body 10 and the hammer body 20 enter the key depression end state shown in FIG. 5C.

In this way, in the weak key touch, the driving of the sloping surface part 22 by the hammer driving part 12 continues until immediately before the end of the key depression stroke, and the load of the hammer body 20 is fully applied to the key body 10, which makes touch feeling heavy, thereby enabling the player to easily play expressively e.g. by dragging.

Next, an operation in the "acoustic piano setting" and in the strong key touch will be described with reference to FIGS. 7A to 7D.

Figure 7A:
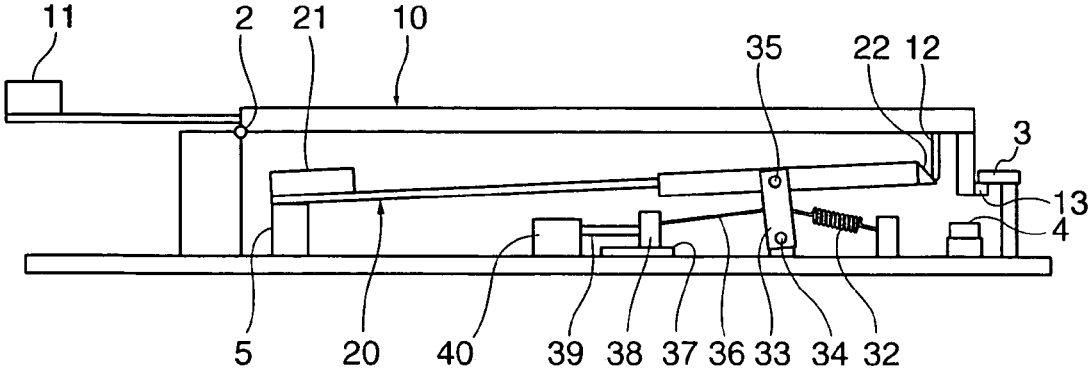

First, when a key is quickly depressed in the non-key-depressed state shown in FIG. 7A (the same state as in FIG. 5A), the hammer driving part 12 and the sloping surface part 22 substantially skip the static frictional state to directly come into the dynamic frictional state. This direct transition occurs due to the force relief mechanism relieving the key depressing force in the longitudinal direction as well as the inertial action of the hummer body 20 having mass. Therefore, at the start of the pivotal motion of the key body 10, the hammer driving part 12 and the sloping surface part 22 are brought into the same state as shown in FIGS. 6J to 6L. Consequently, the hammer body 20 hardly performs pivotal motion in the key depressing direction, but pivotal motion of the pivot arm 33 in the counterclockwise direction causes the hammer body 20 to quickly shift rearward.

Figure 7B:
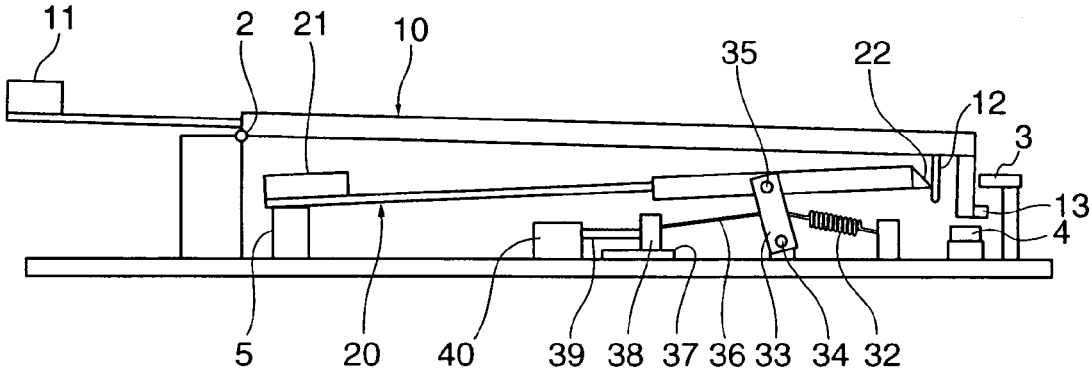
Figure 7C:
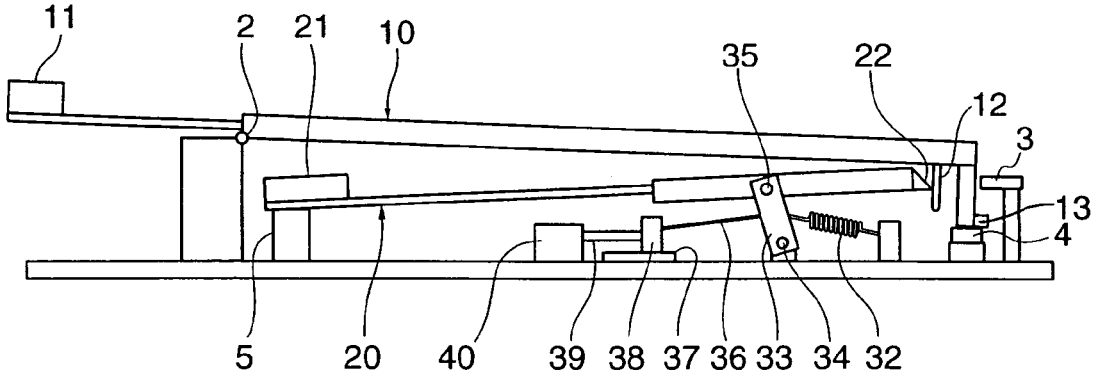
Figure 7D:
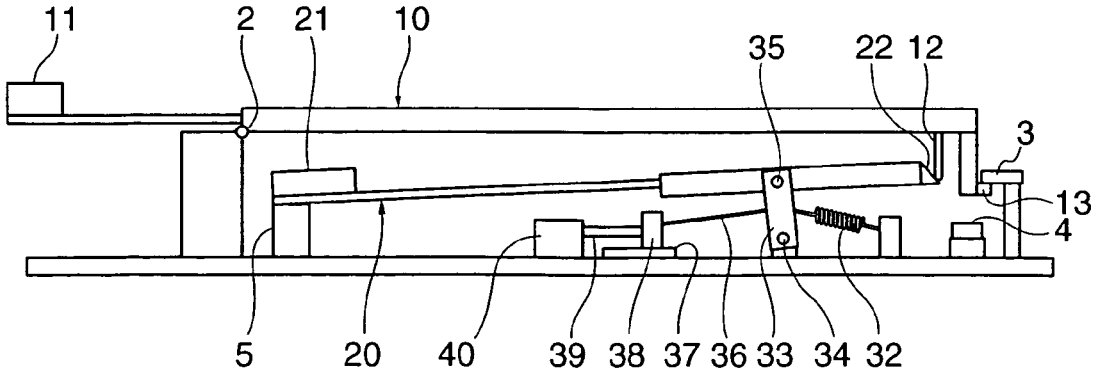

Then, at a much earlier stage than the end of the key depression, the hammer driving part 12 is disengaged from the sloping surface part 22, as shown in FIG. 7B, and the friction-based driving of the sloping surface part 22 by the hammer driving part 12 terminates, whereby, as shown in FIG. 7C, the key body 10 and the hammer body 20 enter the same key depression end state as shown in FIG. 5C. Therefore, in the forward key depression stroke, the load of the hammer body 20 is hardly applied to the key body 10, which makes touch feeling light. Transition of the state shown in FIGS. 7C to 7D after cancellation of the key depressing force is the same as that shown in FIGS. 5C to 5D.

In this way, in the strong key touch, the driving of the sloping surface part 22 by the hammer driving part 12 terminates at a very early stage of the key depression stroke, so that the touch feels lighter than in the weak key touch, which facilitates quick fingering and repeated key striking, thereby contributing to improvement of expressive playing ability. Further, both in the weak key touch and the strong key touch, during key depression continued after termination of the driving of the sloping surface part 22 by the hammer driving part 12, the load of the hammer body 20 is not applied to the key body 10, so that even in the case of generating a long tone, a weak force suffices to maintain the key-depressed state, which prevents the finger from being easily fatigued.

The amount of clockwise pivotal motion of the hammer body 20 or a clockwise pivotal force applied to the hammer body 20 in transition from the state in FIG. 7A to the state in FIG. 7B varies depending on the key depression intensity. Therefore, there is a possibility that the free end of the hammer body 20 does not separate from the hammer lower limit stopper 5 and the hammer body 20 is not pivotally moved at all. More specifically, when the key depressing velocity is high, the amount of pivotal motion of the hammer body 20 in the clockwise direction (key depressing direction) tends to be smaller than when the key depressing velocity is low. Further, the initial position of the hammer body 20 can be set such that when the key is depressed more quickly than at a predetermined key depressing velocity, the clockwise pivotal motion of the hammer body 20 does not occur at all.

Furthermore, in the "acoustic piano setting", in both of the weak key touch and the strong key touch, the initial position of the hammer body 20 can be set by the initial position adjusting mechanism AM1 to thereby change timing for terminating the driving of the sloping surface part 22 by the hammer driving part 12, without changing the key depressing velocity. Thus, the hammer body 20 can perform different operations at the same key depressing velocity, which makes it possible to change key touch feeling as desired in accordance with a piece of music, a user's taste, and/or the tone color of tones to be generated.

To change key touch feeling, normally, the initial positions of the hammer bodies 20 are commonly adjusted over the whole range of pitches by carrying out the "collective adjustment" on a two-octave basis, whereby all the key bodies 10 can be easily set to provide the same key touch feeling. Further, key touch feeling of each key body 10 can be optimized by the "individual adjustment".

Next, an operation in the "organ setting" will be described with reference to FIGS. 8A to 8D. FIGS. 8A to 8D are side views of the keyboard apparatus in the "organ setting", which show changes with time in the operations of the key body 10 and the hammer body 20. In the "organ setting", the weak key touch and the strong key touch are different in the velocity-of operation, but the same in the manner of change of the operations.

The "organ setting" is set by shifting the initial position of the hammer body 20 rearward by the "collective adjustment" to a position where the key body 10 is held out of contact or engagement with the hammer body 20 over the whole key depression stroke. It should be noted that a standard position of the collective adjustment slide member 45 corresponding to the "acoustic piano setting" and a position of the same corresponding to the "organ setting" may be set as preset positions, and marks or pins indicating the respective preset positions may be provided on the fixed member 46 so as to facilitate switching between the two positions.

Figure 8A:
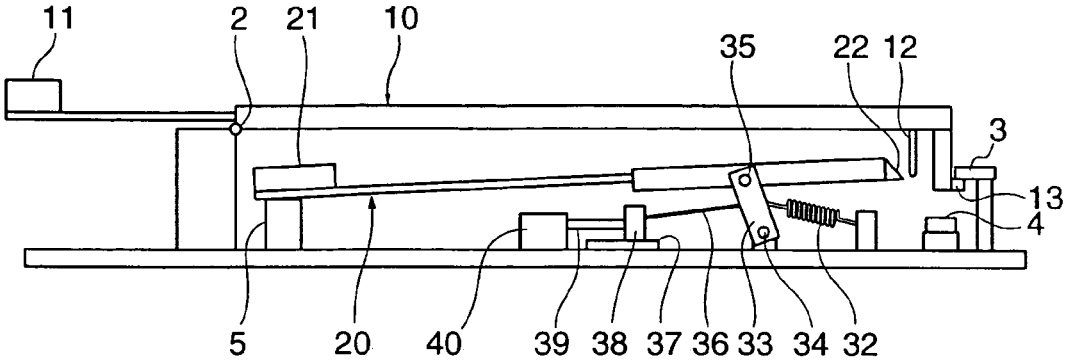
Figure 8B:
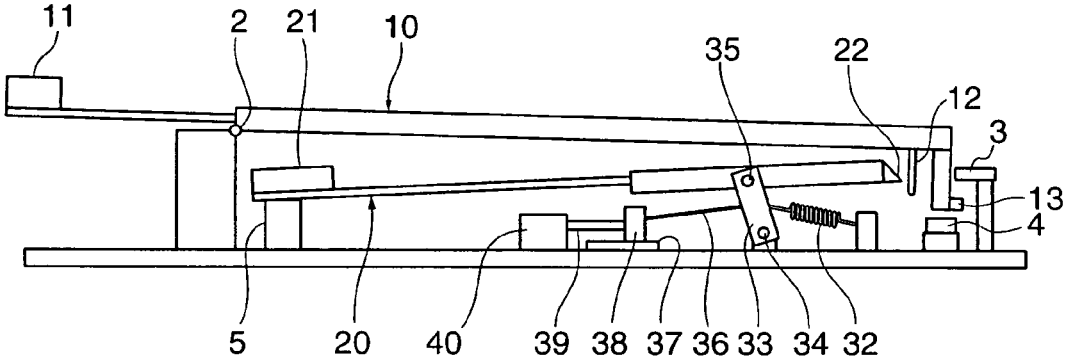
Figure 8C:
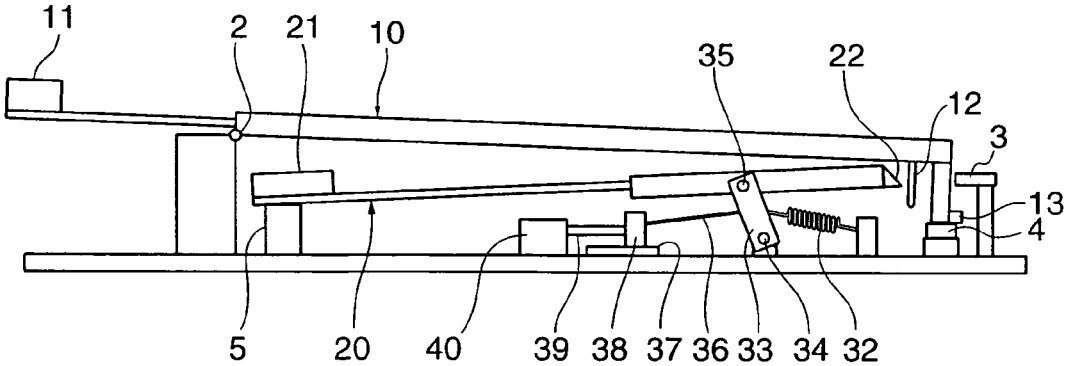
Figure 8D:
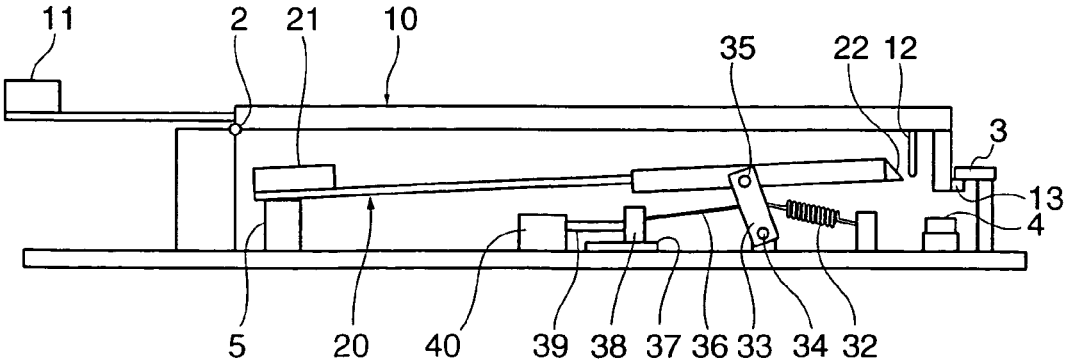

First, in the non-key-depressed state, the hammer driving part 12 of the key body 10 and the front end of the hammer body 20 are apart from each other in the longitudinal direction, as shown in FIG. 8A. Therefore, even when the key is depressed, the hammer driving part 12 cannot be engaged with the sloping surface part 22, as shown in FIGS. 8B and 8C, and hence the key body 10 alone is pivotally moved without receiving the load of the hammer body 20 at all. When the key depressing force is canceled, the key body 10 returns to the non-depressed position (see FIG. 8D).

As is apparent from the above description, the "organ setting" makes a touch on the key body 10 very light, so that the "organ setting" is suitable for playing organ pieces. Thus, the present embodiment makes it possible to easily achieve optimal key touch feeling for organ performance while allowing inertia impartment by the hammer body 20.

The hammer driving part 12 and the sloping surface part 22 are each formed e.g. of a resin, and processing from selection of the material to surface finishing is carried out such that the desired frictional state between the surfaces of the two parts is obtained. Alternatively, a predetermined sheet, e.g. a non-woven fabric formed by application of pressure, may be affixed to the surfaces. The angle of the sloping surface part 22, the shape of the front end of the hammer driving part 12, and so forth, are related to the frictional state. Therefore, it is desirable that these factors are considered comprehensively or tested so as to achieve an optimal combination.

So far, the descriptions have been given by taking the key body 10 as a white key as an example, but a black key, not shown, is similar in construction to the key body 10. The black key is also provided with parts, not shown, identical in construction to the spring engaging part 31, the spring 32, the pivot arm 33, and the thread 36, and a hammer body associated therewith is similar to the hammer body 20 in that its initial position can be adjusted. It should be noted that the same mechanism as that comprised of the initial position adjusting mechanism AM1, the spring engaging parts 31, the springs 32, the pivot arms 33, and the threads 36 may be additionally provided for the black keys.

According to the present embodiment, in the "acoustic piano setting", the state of engagement (frictional state) between the key body 10 and the hammer body 20 is suddenly changed as the key depression velocity is changed across a predetermined value. Consequently, in the weak key touch, that is, when the key is depressed at a velocity not higher than the predetermined key depressing velocity, the hammer driving part 12 and the sloping surface part 22 are engaged with each other while being held in the static frictional state over a wide range of the key depression stroke other than the latter half of the key depression stroke, whereas in the strong key touch, that is, when the key is depressed at a velocity higher than the predetermined key depressing velocity, the engagement in the static frictional state terminates at a very early stage of the key depression stroke. In the dynamic frictional state, the rearward motion of the hammer body 20 has priority over the pivotal motion of the same in the key depressing direction, so that the hammer body 20 is hardly moved in the key depressing direction. On the other hand, in the static frictional state, the hammer body 20 is mainly moved in the key depressing direction. Therefore, in the strong key touch, the load of the hammer body 20 applied to the key body 10 is smaller than in the weak key touch. The hammer body 20 is driven by the key body 10 via sliding friction generated between the hammer driving part 12 and the sloping surface part 22, to impart an inertial force to the key body 10. During the increase in the frictional force, the frictional state between the hammer driving part 12 and the sloping surface part 22 is suddenly changed from the static frictional state to the dynamic frictional state to relieve the frictional force, whereby the above described operation of the hammer body 20 dependent on the key depression intensity is realized. Thus, touch feeling in the strong key touch can be set to be lighter than that in the weak key touch. The inertial force imparted to the key body 10 by the hammer body 20 acts lightly in the strong key touch and heavily in the weak key touch, whereby key touch feeling required for carrying out expressive musical performance can be achieved. In this respect, key touch feeling of the present keyboard apparatus is not the same as that of a general acoustic piano, but if only the player gets accustomed to the touch that feels light only in the strong key touch, there is a possibility that key touch feeling is valued as more excellent than that of the acoustic piano.

Further, in the "acoustic piano setting", the driving of the sloping surface part 22 of the hammer body 20.by the hammer driving part 12 of the key body 10 terminates halfway during the key depression stroke, and hence the load of the hammer body 20 is not applied to the key body 10 at the end of the key depression. Therefore, even in the case of maintaining the key-depressed state, it is possible to minimize the fatigue of the finger. In the weak key touch, touch feeling becomes light as is the case with the operation after the state shown in FIG. 5C. This enables impartment of the same let-off feeling as sensed in both strong touch and weak touch achieved in the acoustic piano, particularly in a grand piano.

Further, since the hammer body 20 pivotally moves about the upper pivot 35 of the pivot arm 33, and the forward and rearward motion of the hammer body 20 is achieved by the pivotal motion of the pivot arm 33 about the lower pivot 34, high durability of the turning and moving mechanisms of the hammer body 20 can be ensured.

Furthermore, since the position or posture of the pivot arm 33 is stabilized by the forward biasing force of the spring 32 and the tension of the thread 36, the initial position of the pivot arm 33 can be stably maintained.

According to the present embodiment, the initial position of the hammer body 20 in the longitudinal direction can be adjusted by the initial position adjusting mechanism AM1 to thereby switch between the roughly defined two settings, i.e. the "acoustic piano setting" and the "organ setting", which makes it possible to easily realize key touch feelings of respective quite different keyboard apparatuses, i.e. an acoustic piano and an organ, by a single keyboard apparatus. In addition, in-the "acoustic piano setting", the degree of engagement between the hammer driving part 12 and the sloping surface part 22 can be adjusted in a continuous or stepless manner by the initial position adjusting mechanism AM1, which makes it possible to change the timing for terminating the driving in a forward key depression stroke of the sloping surface part 22 by the hammer driving part 12 as desired. Therefore, it is possible to vary the manner of application of the inertial force to the key body 10 to thereby change key touch feeling the hammer driving part 12 distinctly and over a wide range.

Further, since the initial position adjusting mechanism AM1 is capable of collectively adjusting two-octave hammer bodies 20, key touch feelings of a plurality of keys can be collectively changed, thereby facilitating the operation of changing key touch feeling. Moreover, since the individual adjustment part 38 is provided, key touch feeling of each key can be adjusted individually, which is convenient in fine adjustment.

Although in the present embodiment, the initial position adjusting mechanisms AM1 are provided on a two-octave basis, this is not limitative, but it is possible to provide an initial position adjusting mechanism AM1 for each predetermined audio frequency range, thereby enabling collective adjustment of key touch feeling of keys in each predetermined audio frequency range so as to provide key touch feelings quite different from audio frequency range to audio frequency range. For example, an application can be considered in which in a single keyboard apparatus, key touch feelings corresponding to respective audio frequency ranges are made quite different from each other such that key touch feeling of a grand piano can be obtained in the low audio frequency range, and key touch feeling of an upright piano or an organ in the high audio frequency range. Further, key touch feeling in an intermediate state between a piano state and an organ state, which cannot be provided by the conventional keyboard apparatuses, can also be easily achieved.

Although in the present embodiment, a predetermined direction other than the direction of the pivotal motion of the hammer body 20, in which the hammer body 20 is movable, is the rearward direction, this is not limitative. For the purpose of relieving the frictional force generated between the hammer driving part 12 and the sloping surface part 22, the predetermined direction may be any direction that is different from the key depressing direction. Further, for the purpose of varying the engagement between the hammer driving part 12 and the sloping surface part 22, the predetermined direction may be any direction containing a component vertical to the direction of the pivotal motion of the hammer body 20.

Although in the initial position adjusting mechanism AM1, the "acoustic piano setting" and the "organ setting" are generally set by the collective adjustment part 40, a mechanism for carrying out two-position switching between the two settings and a mechanism for changing the setting in a continuous or stepless manner may be provided together, in place of the collective adjustment part 40. Alternatively, the initial position adjusting mechanism AM1 may be configured such that the individual adjustment part 38 is used as a mechanism for changing the setting in a continuous or stepless manner, and apart from the individual adjustment part 38, a mechanism for carrying out the two-position switching may be provided in place of the collective adjustment part 40.

Although in the present embodiment, the collective adjustment part 40 is disposed rearward of the individual adjustment part 38, the collective adjustment part 40 may be disposed forward of the individual adjustment part 38 in view of operability. The spring 32 may be replaced by any other suitable member, insofar as it is capable of biasing the pivot arm 33 forward.

Next, variations of the first embodiment will be described with reference to FIGS. 9A to 12D.

FIGS. 9A to 9D are schematic views of a driving part and a driven part according to a variation 1 of the first embodiment. In the first embodiment (the keyboard apparatus in FIG. 1), the lower end of the hammer driving part 12 as the driving part is formed to have an arcuate shape in side view, and the sloping surface part 22 of the hammer body 20 as the driven part is formed as an even surface. In the variation 1, the relationship in shape between the two parts is reversed such that the driving part 51 is formed to have a sloping surface and the driven part 52 is formed to have an arcuate shape in side view.

Figure 9A:
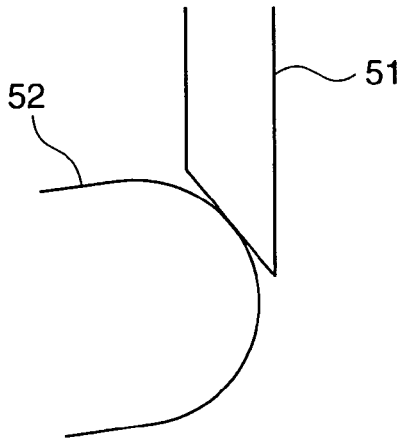
Figure 9B:
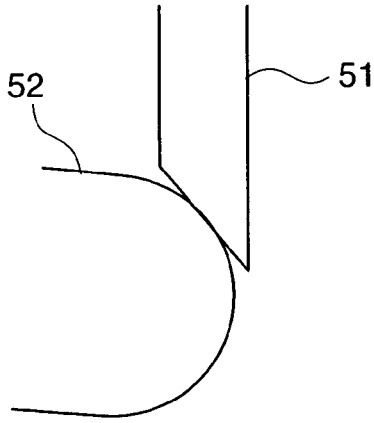
Figure 9C:
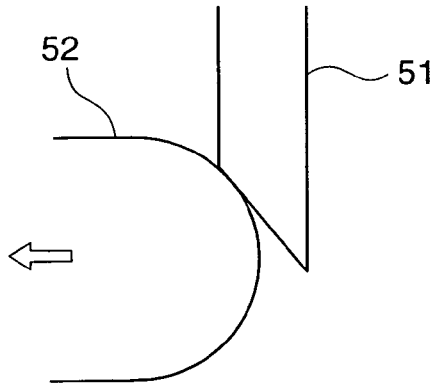
Figure 9D:
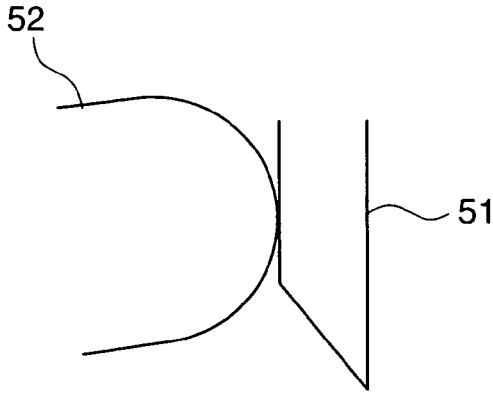

With this arrangement as well, the driving part 51 and the driven part 52 in engagement act in the same manner as in the first embodiment. More specifically, in states shown in FIGS. 9A and 9B, the two parts are in the same static frictional state as that shown in FIGS. 6A and 6D. In a state shown in FIG. 9C, the two parts come into a dynamic frictional state as the hammer driving part 12 and the sloping surface part 22 do in FIG. 6J, and then, as shown in FIG. 9D, the driving part 51 is disengaged from the driven part 52 as the hammer driving part 12 is in FIG. 6M. Therefore, it is possible to provide the same advantageous effects as provided by the first embodiment.

FIGS. 10A to 10D are schematic views of a driving part and a driven part according to a variation 2 of the first embodiment. In the variation 2, a cylindrical roller 55 as the driven part is rotatably held by a roller holding part 54*a* of a hammer body 54. The driving part 53 has a lower end thereof formed in an arcuate shape in side view.

Figure 10A:
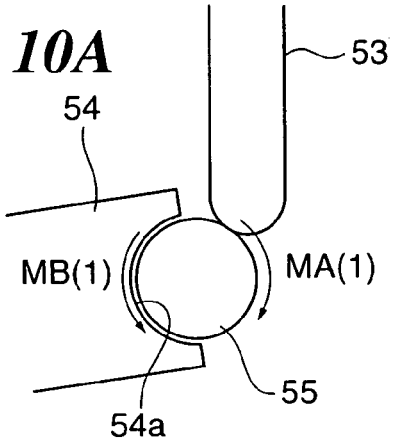
Figure 10B:
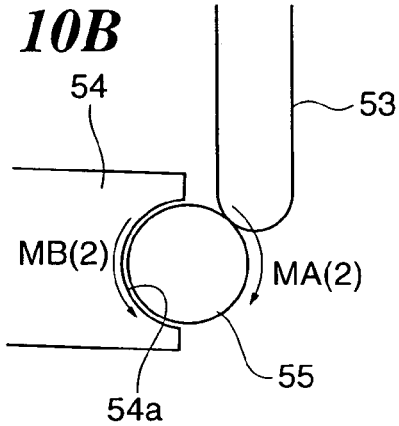

First, as shown in FIG. 10A, in an early stage of key depression, a moment MA (1) in a clockwise direction as viewed in FIG. 10A acts on the roller 55 from the driving part 53. On the other hand, in the hammer body 54, the roller 55 is in a static frictional state with respect to the roller holding part 54*a* of the hammer body 54, and a moment MB (1), which is generated by a frictional force in a counterclockwise direction as viewed in FIG. 10A, acts on the roller 55. At this time point, the moment MA (1) and the moment MB (1) are balanced with each other. Therefore, the roller 55 does not rotate, and the hammer body 54 itself pivotally moves as the hammer body 20 does in the state shown in FIG. 6A.

Figure 10C:
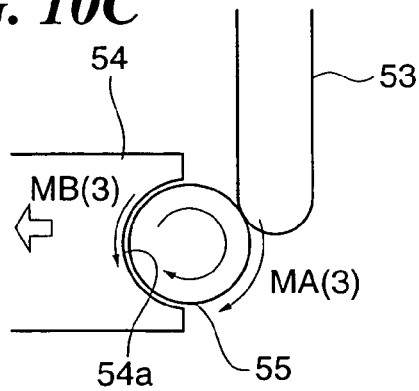
Figure 10D:
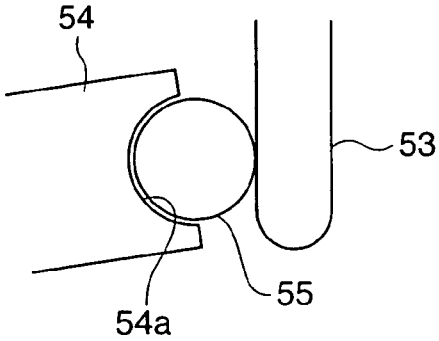

Then, after the pivotal angle of the hammer body 54 changes and the moment MA (2) reaches a limit of the balance with the moment MB (2) (see FIG. 10B), the sliding frictional state between the roller 55 and the roller holding part 54*a* of the hammer body 54 suddenly changes from the static frictional state to a dynamic frictional state, and the moment MA (3) exceeds the moment MB (3) to cause clockwise rotation of the roller 55 (see FIG. 10C). As a consequence, the hammer body 54 shifts rearward as the hammer body 20 does in the state shown in FIG. 6J, and then, as shown in FIG. 10D, the driving part 53 is disengaged from the roller 55 as the hammer driving part 12 is disengaged from the hammer body 20 in FIG. 6M.

FIGS. 10E to 10H are schematic views of a driving part and a driven part according to a variation 3 of the first embodiment. In the variation 3, a hammer body 58 is formed with a driven part 59 with a sloping surface similar to the sloping surface part 22 of the keyboard apparatus of the first embodiment, and a cylindrical roller 57 is rotatably held by a roller holding part 56*a* of the driving part 56.

Figure 10E:
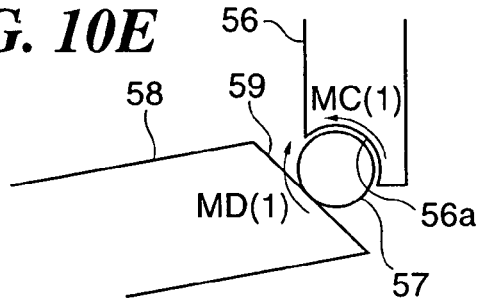
Figure 10F:
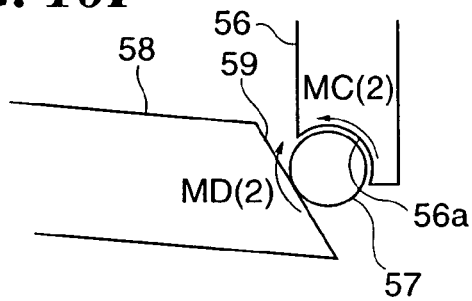

First, as shown in FIG. 10E, in an early stage of key depression, a moment MD (1) in a clockwise direction as viewed in FIG. 10E acts on the roller 57 from the driving part 59. On the other hand, in the driving part 56, the roller 57 is in a static frictional state with respect to the roller holding part 56*a* of the driving part 56, and a moment MC (1), which is generated by a frictional force in a counterclockwise direction as viewed in FIG. 10E, acts on the roller 57 from the roller holding part 56*a*. At this time point, the moment MD (1) and the moment MC (1) are balanced with each other. Therefore, the roller 57 does not rotate, and the hammer body 58 itself pivotally moves as the hammer body 20 does in the state shown in FIG. 6A.

Figure 10G:
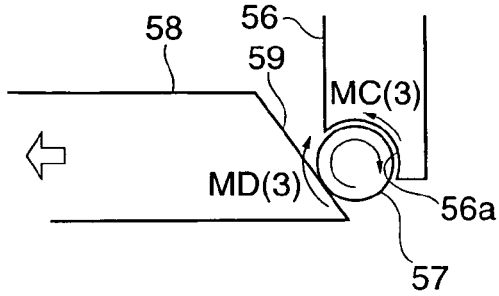
Figure 10H:
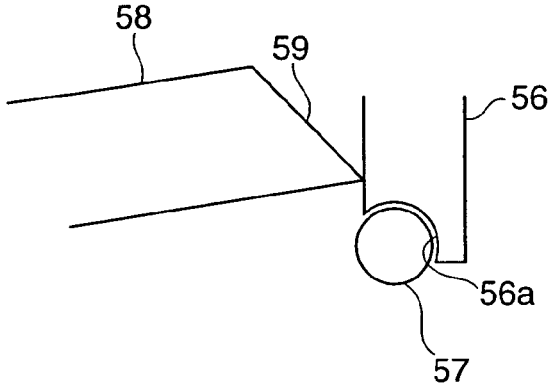

Then, after the pivotal angle of the hammer body 58 changes and the moment MD (2) reaches a limit of the balance with the moment MC (2) (see FIG. 10F), the sliding frictional state between the roller 57 and the roller holding part 56*a* suddenly changes from the static frictional state to a dynamic frictional state, and the moment MD (3) exceeds the moment MC (3) to cause clockwise rotation of the roller 57 (see FIG. 10G). As a consequence, the hammer body 58 shifts rearward as the hammer body 54 does in the state shown in FIG. 10C, and then, as shown in FIG. 10H, the driving part 56 is disengaged from the driven part 59 as the driving part 53 is disengaged from the roller 55 in FIG. 10D.

In the variations 2 and 3 as well, in which the hammer body is driven not through friction directly generated between the key body and the hammer body, but through friction generated between the roller holding part of the hammer body or the key body and the roller, changes in the action of the frictional force are basically the same as those in the first embodiment. Therefore, the variations 2 and 3 can provide the same advantageous effects as provided by the first embodiment.

It should be noted that by providing both of the hammer body and the key body with a roller, the same function and actions can be achieved.

Figure 11A:
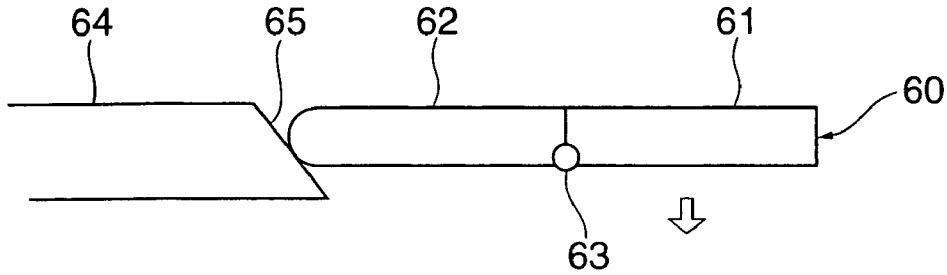
Figure 11B:
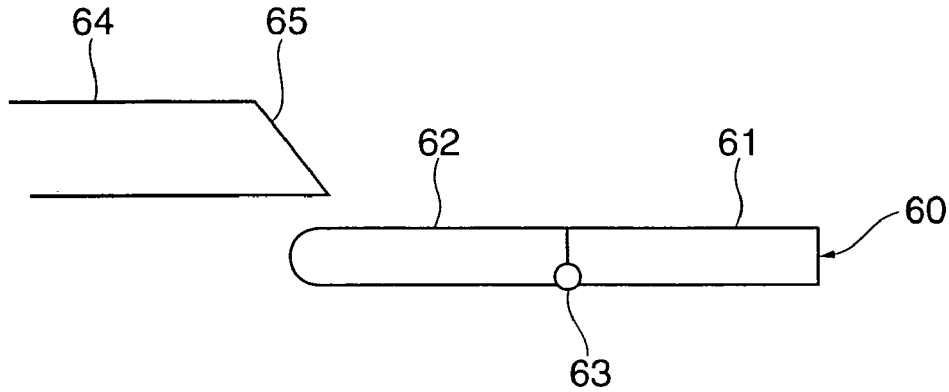
Figure 11C:
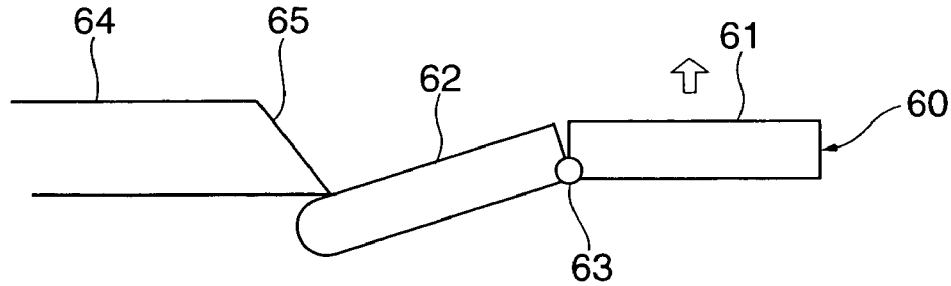

FIGS. 11A to 11C are schematic views of a driving part and a driven part according to a variation 4 of the first embodiment. In the variation 4, a driving part, which can be bent, is used. More specifically, the driving part 60 corresponding to the hammer driving part 12 is comprised of a base part 61, and an arm part 62, and is formed such that the arm part 62 can be bent only downward about a pivot 63, as viewed in FIGS. 11A to 11C, with respect to the base part 61. Further, the driving part 60 is provided with a biasing member, not shown, for returning the arm part 62 to a state shown in FIG. 11A. On the other hand, a hammer body 64 is formed with a driven part 65 with a sloping surface similar to the sloping surface part 22 of the keyboard apparatus of the first embodiment.

With the construction described above, the action in a forward stroke in which the driving part 60 drives the hammer body 64 is the same as that in the first embodiment. The operation starts from the initial state shown in FIG. 11A and proceeds to a key depression end state shown in FIG. 11B through sliding of the front end of the arm part 62 on the driven part 65, and the pivotal motion and rearward shift of the hammer body 64.

As is distinct from the first embodiment in which a key enters the key depression end state with the front end of the hammer body 20 held in contact with the rear wall of the hammer driving part 12, according to the present variation 4, in the key depression end state, the driving part 60 is positioned below the hammer body 64, and the hammer body 64 need not be in contact with the driving part 60 but has already returned to its initial position.

On the other hand, when the key is released, the driving part 60 moves upward, and the arm part 62 is temporarily bent about the pivot 63, as shown in FIG. 11C, whereby the driving part 60 is allowed to move upward to a level above the hammer body 64 and easily return to its initial position. The variation 4 also ensures the same advantageous effects as provided by the first embodiment.

Figure 11D:
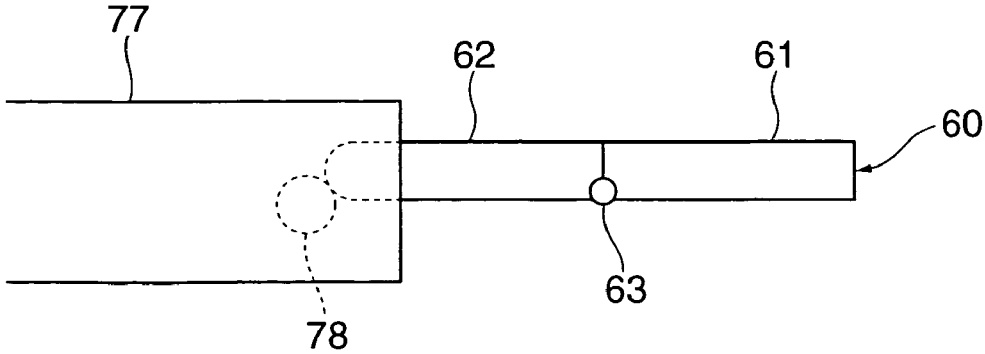

It should be noted that a pin 78 may be provided in a hammer body 77 in a suspended manner, as shown in FIG. 11D, in place of the driven part 65 as the sloping surface, so as to be driven by the driving part 60. Such a configuration in which a pin is used as a driven part can also be applied to the first embodiment and the variations 1 and 3. Further, a configuration in which a bendable driving part is used as described above as the variation 4 by way of example is applicable to each of the driving parts in the first embodiment and the variations 1 to 3.

Next, a description will be given of another configuration in which a moving mechanism moves a hammer body in the longitudinal direction as a variation 5 of the first embodiment. In the first embodiment, the forward or rearward shift of the hammer body 20 is realized by the pivotal motion of the pivot arm 33 about the lower pivot 34, but other forms of moving mechanisms can be considered.

Figure 12A:
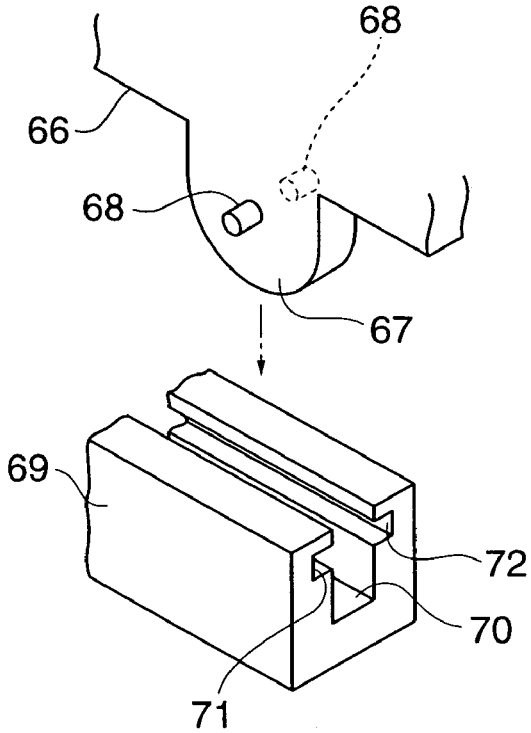
FIG. 12A is a perspective view showing essential parts of a moving mechanism for moving a hammer body in a longitudinal direction according to a variation 5 of the first embodiment.

FIG. 12A is a perspective view showing essential parts of a moving mechanism for moving a hammer body in the longitudinal direction, according to the variation 5 of the first embodiment.

A support member 69 is fixed to the chassis 1 in place of the pivot arm 33. A hammer body 66 has a lower part formed with a suspending part 67 extending downward therefrom, and cylindrical pins 68 are projected laterally from the suspending part 67. The suspending part 67 has a lower edge thereof formed in an arcuate shape in side view. The support member 69 is configured similarly to a sliding member shown in FIG. 3 of Japanese Patent No. 3324384. More specifically, the support member 69 is formed therein with a U-shaped main guide groove 70 extending in the longitudinal direction, for guiding the suspending part 67, and pin guide grooves 71 and 72 for guiding the pins 68 are formed in the respective left and right inner side surfaces of the main guide groove 70 and extend in the longitudinal direction.

The suspending part 67 of the hammer body 66 is fitted in the main guide groove 70 of the support member 69, and the pins 68 are fitted in the pin guide grooves 71 and 72. When the hammer body 66 receives a force acting in the key depressing direction, the arcuate suspending part 67 rolls in the main guide groove 70, which causes pivotal motion of the hammer body 66. On the other hand, when the hammer body 66 receives a force acting in the rearward direction, the suspending part 67 slides rearward along the main guide groove 70, whereby the hammer body 66 shifts rearward. At this time, the pins 68 also slide along the pin guide grooves 71 and 72, so that the hammer body 66 can smoothly move forward and rearward irrespective of a position where the hammer body 66 pivotally moves. In addition, since the pins 68 are fitted in the pin guide grooves 71 and 72, it is possible to prevent the hammer body 66 from falling out from the support member 69 even when a shocking key touch is applied.

In the variation 5 as well, high durability of the turning and moving mechanisms of the hammer body can be ensured, and therefore it is possible to provide the same advantageous effects as provided by the first embodiment.

Figure 12C:
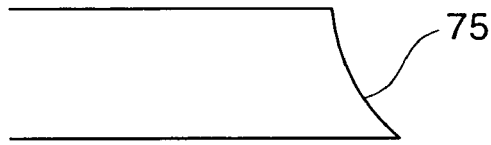
FIGS. 12C and 12D are side views showing examples of driven parts according to still other variations.
Figure 12B:
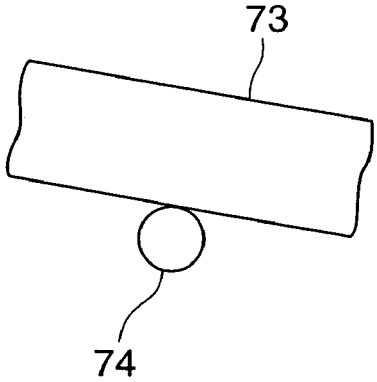
FIG. 12B is a schematic view showing essential parts of a moving mechanism for moving a hammer body in the longitudinal direction according to another variation.

It should be noted that for the purpose of simplifying the construction of the moving mechanism for moving the hammer body in the longitudinal direction, it is possible to employ a configuration in which a hammer body 73 is placed on a cylindrical pivot 74 as shown in FIG. 12B.

Figure 12D:
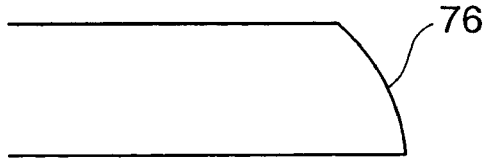

Although in each of the first embodiment and the variations 1, 3 and 4, the driving part or the driven part is formed as having an even sloping surface, this is not limitative, but the shape of the sloping surface may be a concave sloping surface 75 shown in FIG. 12C or a convex sloping surface 76 shown in FIG. 12D, for example. In this case, the horizontal component forces and vertical component forces applied to the driven part in a key depression stroke are not changed in a linear fashion, but can be changed in a desired fashion by adjusting the curvature of the curved surface, which makes it easier to further approximate key touch feeling to a desired one.

Figure 13:
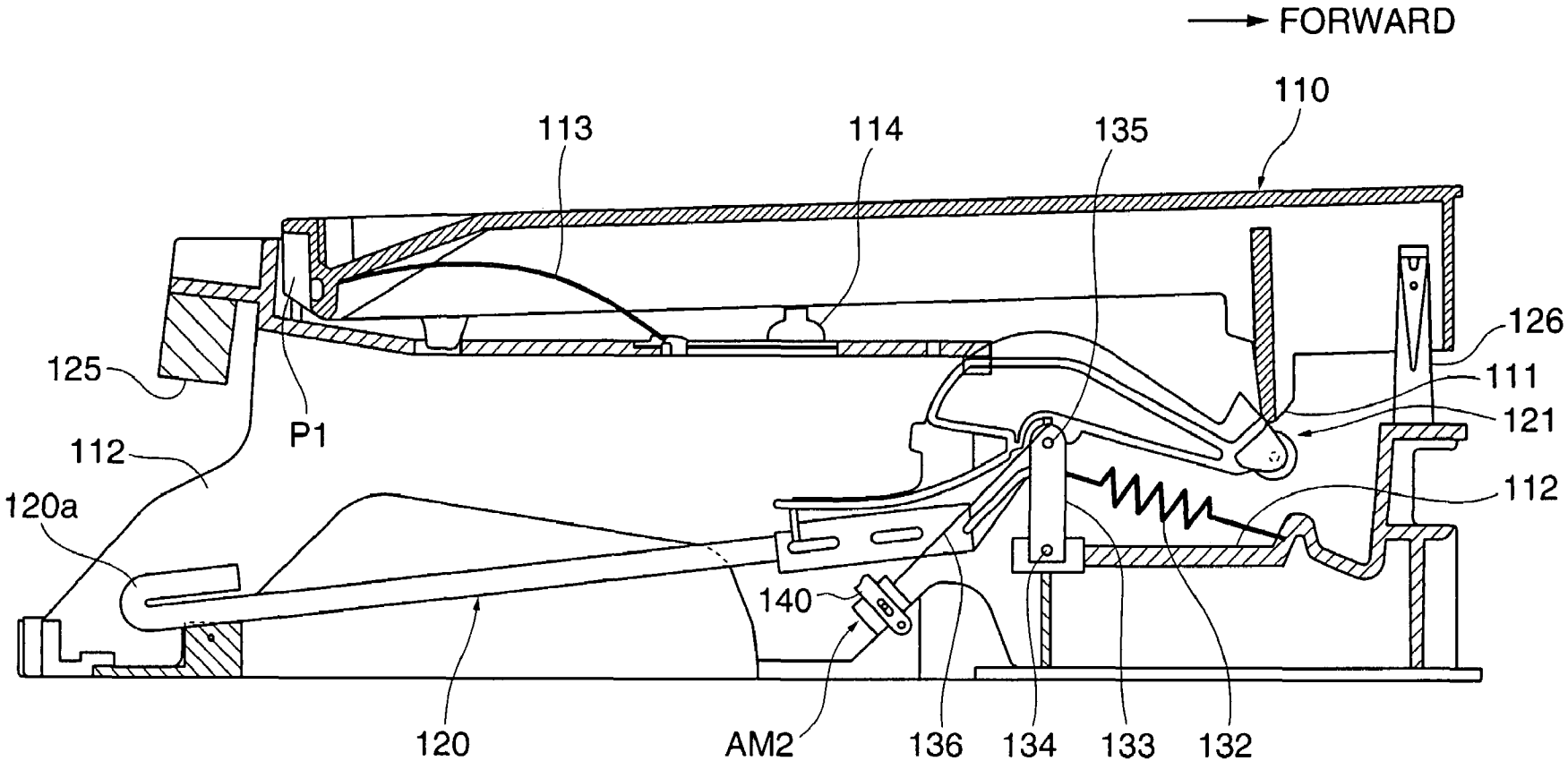
FIG. 13 is a side view of a keyboard apparatus according to a second embodiment of the present invention.

FIG. 13 is a side view of a keyboard apparatus according to a second embodiment of the present invention. The keyboard apparatus of the present embodiment has a chassis 112 on which are supported key bodies 110 (a white key is shown in FIG. 13) to be depressed, hammer bodies 120 each for applying a moderate inertial force to a key body 110 associated therewith during key depression, and so forth, such that they can perform vertical swinging motion. Hereafter, the free end side (the right side as viewed in FIG. 13) of the key body 110 will be referred to as "the front".

The key body 110 is supported such that it can perform vertical pivotal motion about a key pivot P1. A return spring 113 is stretched at an uppermost location in the chassis 112 between an approximately longitudinally central part and a rear part of the key body 110. A hammer driving part 111 for driving the hammer body 120 extends downward from a front lower part of the key body 110. On the top of the chassis 112, there is disposed a key-on switch 114, and on the front part of the chassis 112, there is provided a key guide 126. Further, an upper limit setting stopper 125 is disposed on a rear upper part of the chassis 112.

A lower pivot 134 is fixedly provided on the chassis 112. Further, on the chassis 112, there is attached a pivot arm 133 pivotally movable about the lower pivot 134 in the clockwise and counterclockwise directions as viewed in FIG. 13. The hammer bodies 120 are provided in a one-to-one correspondence with the key bodies 110, and are supported such that they can perform vertical pivotal motion about respective associated upper pivots 135 of the pivot arms 133. Each of the hammer bodies 120 has a driven part 121, described in detail hereinafter, formed on a foremost end thereof.

A front side of the pivot arm 133 and a front part of the chassis 112 are connected to each other by a spring 132. An initial position adjusting mechanism AM2 is disposed on the chassis 112 at a location rearward of the pivot arm 133. A thread 136 has one end thereof attached to a rear side of the top of the pivot arm 133, and the other end thereof connected to a part (described hereinafter) of the initial position adjusting mechanism AM2. The spring 132, the pivot arm 133, and the thread 136 are provided in a one-to-one correspondence with the key bodies 10. These members are different in positional relationship and shape from the spring 32, the pivot arm 33, and the thread 36 in the first embodiment, but are similar in function to them.

Figure 14A:
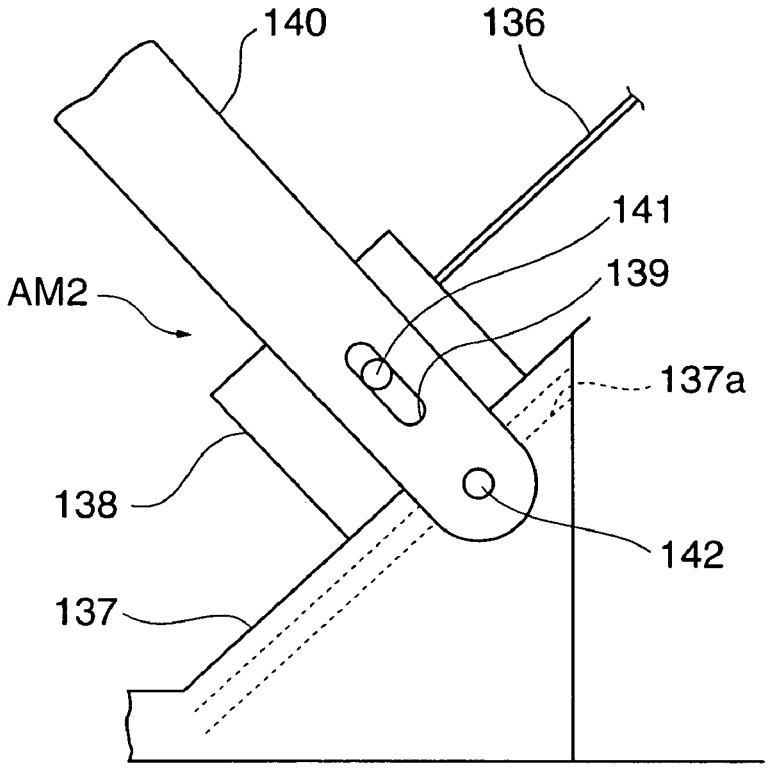
Figure 14B:
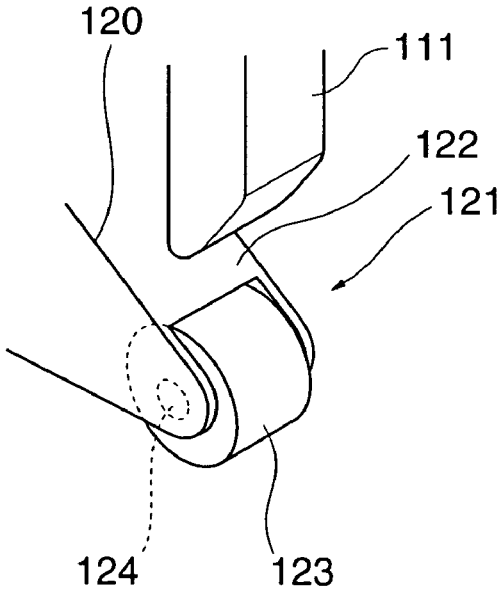
Figure 14C:
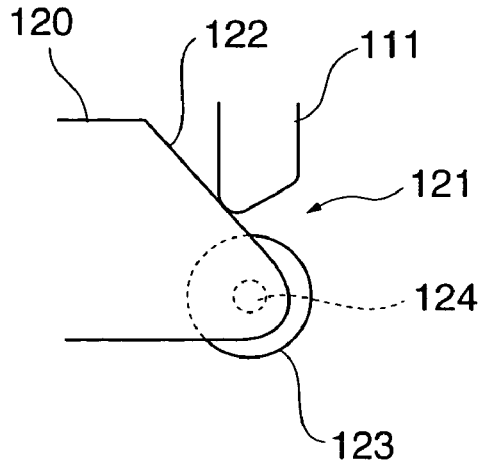

FIG. 14A is a side view showing details of the arrangement of the initial position adjusting mechanism AM2 of the keyboard apparatus of the present embodiment. FIG. 14B is a perspective view of the driven part 121, and FIG. 14C is a side view schematically showing the driven part 121 and the hammer driving part 111.

The initial position adjusting mechanism AM2 includes a slide base 137, a common slide member 138, and an operating arm 140. The slide base 137 is formed therein with guide grooves 137*a* similar to the guide grooves 37La and 37Ra (see FIG. 3), and a lower portion of the common slide member 138 corresponding to the guide grooves 137*a* is formed in a shape fittable in the guide grooves 137*a*. The guide grooves 137*a* extend along a direction substantially parallel with a line connecting between the initial position adjusting mechanism AM2 and the top of the pivot arm 133 (i.e. substantially the same direction as the longitudinal direction of the thread 136), and hence the common slide member 138 is movable in this direction.

The operating arm 140 is allowed to pivotally move about a pivot 142 provided in the slide base 137 in clockwise and counterclockwise directions as viewed in FIG. 14A. The operating arm 140 is formed therein with a slot 139 in which is fitted a pin 141 projecting from the common slide member 138. The thread 136 is connected to the common slide member 138.

The slide base 137 is disposed on each of the left and right sides of a group of key bodies 110 corresponding to a predetermined number of octaves. The left and right slide bases 137 are symmetrical. The common slide member 138 is bridged between the left and right slide bases 137. The group of key bodies 110 corresponding to the predetermined number of octaves is provided with at least one operating arm 140, i.e. one on one side thereof or two on the respective opposite sides thereof, for example.

With the construction described above, when the user pivotally moves the operating arm 140, the common slide member 138 is moved via the slot 139 and the pin 141 in the direction set for movement along the slide bases 137. As a consequence, the pivot arm 133 has its pivotal position set as the pivot arm 33 does in the first embodiment, so that the initial positions of the respective hammer bodies 120 associated with the key bodies 110 corresponding to the predetermined number of octaves can be collectively adjusted.

As shown in FIG. 14B, the driven part 121 has a front end thereof provided with a cylindrical roller 123 such that the roller 123 can rotate about a rotational shaft 124. Differently from the rollers 55 and 57 shown in FIGS. 10A to 10H, the roller 123 is configured such that sliding friction during rotation is minimized. Further, as shown in FIG. 14C, the driven part 121 is formed with a sloping surface part 122 similar to the sloping surface part 22 of the hammer body 20 in the first embodiment. The roller 123 is slightly projected vertically from a lower part of the sloping surface part 122.

With the construction described above, when the driven part 121 is driven in the weak key touch by the hammer driving part 111, the hammer driving part 111 and the sloping surface part 122 act relative to each other in the same manner as the hammer driving part 12 and the sloping surface part 22 in the first embodiment (see FIGS. 6A to 6L) up to a halfway point (i.e. until the hammer driving part 111 comes into contact with the roller 123).

However, when the hammer driving part 111 comes into contact with the roller 123, the projection of the roller 123 from the lower part of the sloping surface part 122 causes a temporary increase in the key depression reaction force, or temporarily lowers the degree of reduction of the key depression reaction force. As a result, the same let-off feeling as obtained from the acoustic piano can be positively sensed.

Further, as is distinct from the first embodiment in which no upper limit stopper for the hammer body 20 is provided, in the present second embodiment, the upper limit setting stopper 125 is provided as mentioned above. In a normal key-depressed state, a rear end part 120*a* of the hammer body 120 is never brought into contact with the upper limit setting stopper 125, but even when the pivotal motion end position of the hammer body 120 is shifted to an unexpected position due to aging (including changes in the frictional state) or an excessively rough key touch, a shock applied to the finger from the key body 110 is reduced by the upper limit setting stopper 125.

The present embodiment can not only provide the same advantageous effects as provided by the first embodiment except those associated with individual adjustment of the initial position of each hammer body, but also further facilitate collective adjustment of the respective initial positions of the hammer bodies. Further, since the roller 123 is provided in the driven part 121, the same let-off feeling as peculiarly sensed in the weak key touch on the acoustic piano can be clearly or positively realized. On the other hand, in the strong key touch, a driving force of the hammer driving part 111 is not transmitted to the roller 123, but transmitted to the hammer body 120 in the initial stage of key depression, so that in this case as well, the same let-off feeling as sensed generally in the weak key touch on the acoustic piano can be realized.

Also in the second embodiment, it is desirable to provide a mechanism similar to the initial position adjusting mechanism AM1 in the first embodiment so as to enable individual adjustment of the initial position of each hammer body. It should be noted that a weight having a function for returning the key body 110, which is similar to the function of the weight 11 in the first embodiment, may be provided e.g. in the front part of the key body 110.

Referring again to the first embodiment, the mechanism for moving the collective adjustment slide member 45 on the fixed member 46 may be implemented by the mechanism operated by the operating arm 140 in the second embodiment. Further, the roller 123 in the second embodiment may be employed in the first embodiment.

The mechanism for adjusting the initial positions of the hammer bodies is not limited to the mechanisms described in the first and second embodiments by way of example. Further, the operating method for adjustment is not limited to the manual one, but an electric/electromagnetic moving mechanism may be used. Furthermore, a thread take-up mechanism may be employed as a mechanism for holding the thread under tension like the initial position adjusting mechanism AM1 and the initial position adjusting mechanism AM2. In this case, the initial position of each hammer body is adjusted based on a take-up amount.

Figure 15:
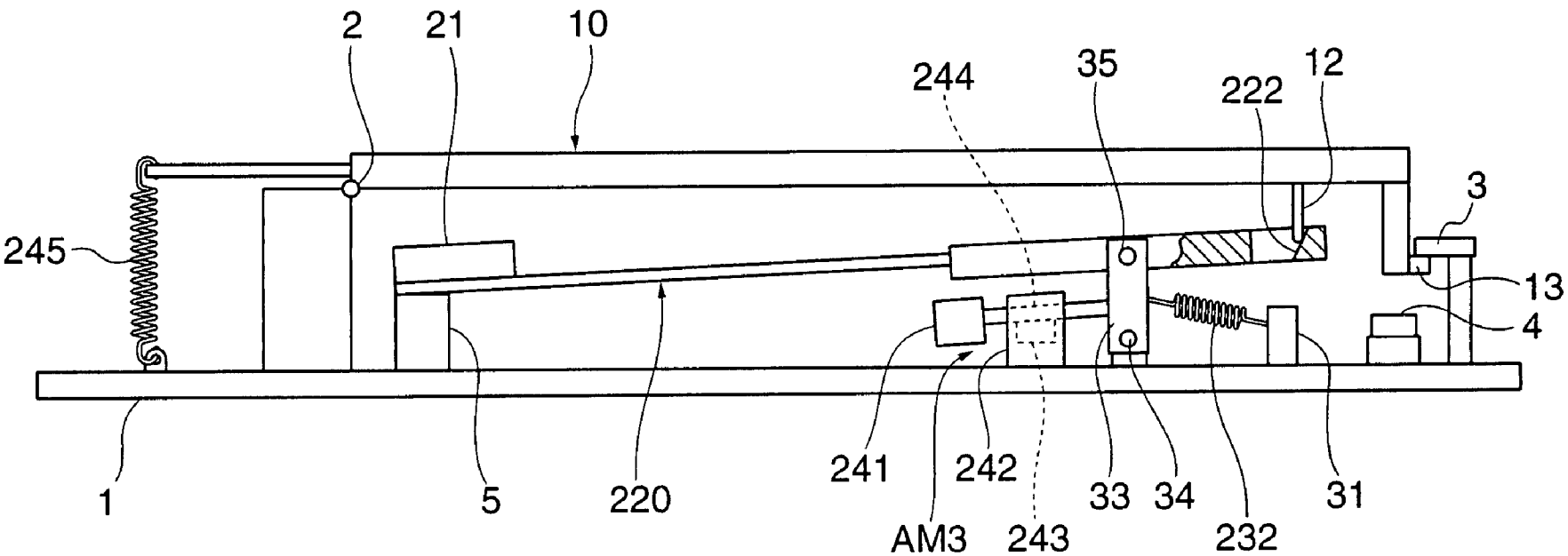
FIG. 15 is a side view of a keyboard apparatus according to a third embodiment of the present invention.

FIG. 15 is a side view of a keyboard apparatus according to a third embodiment of the present invention. The third embodiment is basically distinguished from the first embodiment in that with key depression, a hammer body 220 corresponding to the hammer body 20 moves not rearward, but forward. Therefore, in addition to the hammer body 220, a spring 232 as a compression spring and an initial position adjusting mechanism AM3 are employed in place of the spring 32 as a tension spring and the initial position adjusting mechanism AM1, respectively. Further, as a member having the function for returning the key body 10, a tension spring 245 is provided at the rear end of the key body 10 in place of the weight 11.

At the foremost part of the hammer body 220, there is formed an even sloping surface part 222 facing rearward and upward, and the sloping surface part 222 functions as a driven part driven by the hammer driving part 12 of the key body 10. The front side of the pivot arm 33 and the spring engaging part 31 are connected to each other by the spring 232.

The initial position adjusting mechanism AM3 is comprised of a gear base 242 fixed to the chassis 1, a gear 243 fixed to the gear base 242, and a worm 244 in mesh with the gear 243. The worm 244 is rotated by a motor 241. The worm 244, which is in mesh with the gear 243, moves generally in the longitudinal direction while rotating. The stop position of the motor 241 is defined by a position sensor, not shown, which detects the forward and rearward motions of the worm 244.

When the upper half part of the pivot arm 33 is pivotally biased rearward about the lower pivot 134 by the spring 232, the front end of the worm 244 abuts against the rear wall of the pivot arm 33 to withstand the urging force of the spring 232. This makes it possible to adjust the initial position of the pivot arm 33 by changing the position of the worm 244. Further, when the hammer body 220 receives a force acting to move the same forward, the spring 232 contracts to allow forward pivotal motion of the pivot arm 33.

Operations during key depression are the same as those in the first embodiment except that the hammer body 220 shifts forward. Further, by adjusting the position of the worm 244 of the initial position adjusting mechanism AM3, the "organ setting" and the "acoustic piano setting" can be set in the same manner as set by the initial position adjusting mechanism AM1.

The present embodiment can provide the same advantageous effects as provided by the first embodiment, except those associated with individual adjustment of the initial position of each hammer body.

What is claimed is:

1. A keyboard apparatus comprising:

a support member;

a plurality of keys that are supported by said support member, for key depressing operations; and an arm that is driven by an associated one of said keys via engagement with the associated key to move in a key depressing direction to thereby impart an inertial force to the associated key when the key is depressed, wherein the associated key is disposed for driving engagement with said arm such that a state of engagement between the associated key and said arm suddenly changes as a depressing velocity of the key changes across a predetermined key depressing velocity, such that when the depressing velocity of the key is higher than the predetermined key depressing velocity, said arm hardly moves in the key depressing direction, and when the depressing velocity is not higher than the predetermined key depressing velocity, said arm moves in the key depressing direction.

2. A keyboard apparatus as claimed in claim 1, wherein the driving engagement of the associated key with the arm is set such that driving of the key by said arm terminates during a depressing stroke of the key.

3. A keyboard apparatus as claimed in claim 1, wherein said arm is movable in the key depressing direction and a predetermined direction different from the key depressing direction, and the associated key is disposed for driving engagement with said arm such that as the depressing velocity of the key is higher, motion of said arm in the predetermined direction has a higher priority over motion of said arm in the key depressing direction.

4. A keyboard apparatus as claimed in claim 2, comprising a pivotal member that has one part thereof supported by said support member, and another part thereof pivotally movable about said one part, said other part having a pivot, and wherein said arm and said pivotal member are disposed relative to each other such that said arm is pivotally movable about the pivot of said other part of said pivotal member, and the motion of said arm in the predetermined direction is realized by pivotal motion of said other part of said pivotal member about said one part.

5. A keyboard apparatus as claimed in claim 2, comprising a biasing device that biases said arm in an opposite direction to the predetermined direction, and a restricting device that defines an initial position of said arm in the predetermined direction.

6. A keyboard apparatus comprising:

a support member;

a plurality of keys that are supported by said support member, for key depressing operations; and an arm that is driven by an associated one of said keys to move in a key depressing direction to thereby impart an inertial force to the associated key when the key is depressed, wherein the associated key is disposed for driving engagement with said arm such that when a depressing velocity of the key is higher, an amount of motion of said arm in the key depressing direction is smaller than when the depressing velocity of the key is lower.

7. A keyboard apparatus comprising:

a support member;

a plurality of keys that each have a driving part and are supported by said support member, for key depressing operations;

an arm that has a driven part driven by said driving part of an associated one of said keys via engagement with said driving part of the associated key, said arm being movable in a key depressing direction by a key depressing force transmitted from the associated key through a frictional force generated by the engagement between said driven part and said driving part of the associated key when said driven part is driven by said driving part, to thereby impart an inertial force to the associated key when the key is depressed, wherein the associated key is disposed for driving engagement with said arm such that when the frictional force increases, the frictional force is relieved.

8. A keyboard apparatus as claimed in claim 7, wherein the associated key is disposed for driving engagement with said arm such that when the key depressing force transmitted from the associated key to said arm is not larger than a predetermined force, the engagement between said driven part and said driving part causes a static frictional state therebetween, whereas when the key depressing force transmitted from the associated key to said arm is not smaller than the predetermined force, the engagement between said driven part and said driving part causes a dynamic frictional state therebetween, and the frictional force is relieved when the static frictional state caused by the engagement between said driven part and said driving part is changed into the dynamic frictional state during an increase in the frictional force.

9. A keyboard apparatus as claimed in claim 8, wherein said arm is movable in the key depressing direction and a predetermined direction different from the key depressing direction, and the associated key is disposed for driving engagement with said arm such that when the engagement between said driven part and said driving part causes the static frictional state, said arm mainly moves in the key depressing direction, whereas when the engagement between said driven part and said driving part causes the dynamic frictional state, said arm moves in the predetermined direction and hardly moves in the key depressing direction.

10. A keyboard apparatus as claimed in claim 9, wherein at least one of said driving part of the associated key and said driven part of said arm has a sloping surface part which is not parallel to the key depressing direction and the predetermined direction different from the key depressing direction, and the associated key is disposed for driving engagement with said arm such that the key depressing force is distributed in the key depressing direction and the predetermined direction according to an inclination angle of the sloping surface part, whereby said arm is made movable in the key depressing direction and the predetermined direction.

11. A keyboard apparatus comprising:

a support member;

a plurality of keys that each have a driving part and are supported by said support member, for key depressing operations within a pivotal range thereof from a key-released state to a key-depressed state;

a key return device that constantly operates to return an associated one of said keys toward the key-released state within the pivotal range of the associated key;

an arm that has a driven part driven by said driving part of the associated key via engagement with said driving part of the associated key, said arm being pivotally moved when said driven part is driven by said driving part of the associated key, to thereby impart an inertial force to the associated key when the key is depressed;

a switching device that switches between a first state where said driven part of said arm is driven by said driving part of the associated key during at least part of a forward key depression stroke, and a second state where said driven part of said arm is never driven by said driving part of the associated key through an entire key depression stroke; and an adjusting device that adjusts a degree of the engagement between said driven part and said driving part in the first state.

12. A keyboard apparatus as claimed in claim 11, wherein said arm is displaceable in a predetermined direction containing a component perpendicular to a direction of pivotal motion of said arm, and said adjusting device adjusts the degree of the engagement between said driven part and said driving part in the first state by displacing said arm in the predetermined direction.

13. A keyboard apparatus as claimed in claim 11, wherein the associated key is disposed for driving engagement with said arm such that in the first state, driving of said driven part by said driving part terminates halfway during the forward key depression stroke of the associated key, and timing in which the driving of said driven part by said driving part terminates during the forward key stroke is changed by said adjusting device adjusting the degree of the engagement between said driven part and said driving part.

14. A keyboard apparatus as claimed in claim 11, wherein said arm comprises a plurality of said arms associated with respective ones of said plurality of keys, and said adjusting device is provided for each of said arms, for adjustment of the degree of the engagement between said driven part of said arm and said driving part of an associated one of said keys.

15. A keyboard apparatus as claimed in claim 11, wherein said arm is displaceable in a predetermined direction containing a component perpendicular to a direction of pivotal motion of said arm, and said switching device displaces said arm in the predetermined direction to thereby switch between the first state and the second state.

16. A keyboard apparatus as claimed in claim 11, wherein said arm comprises a plurality of said arms associated with respective ones of said plurality of keys, and said switching device collectively displaces said plurality of arms in the predetermined direction.

17. A keyboard apparatus as claimed in claim 15, comprising a pivotal member that has one part thereof supported by said support member, and another part thereof pivotally movable about said one part, said other part having a pivot, and wherein said arm and said pivotal member are disposed relative to each other such that said arm is pivotally movable about the pivot of said other part of said pivotal member, and the motion of said arm in the predetermined direction is realized by pivotal motion of said other part of said pivotal member about said one part.

18. A keyboard apparatus as claimed in claim 11, comprising a return biasing device that is disposed for contact with an associated one of said keys in the key-depressed state to thereby set a key depression end position of the associated key, and wherein when said return biasing device is in contact with the associated key, said return biasing device biases the associated key toward the key-released state.

* * * * *